US009151056B2

(12) United States Patent
Konstantin

(10) Patent No.: US 9,151,056 B2
(45) Date of Patent: Oct. 6, 2015

(54) DUAL GLAZING PANEL SYSTEM

(71) Applicant: CPI DAYLIGHTING, INC., Lake Forest, IL (US)

(72) Inventor: Moshe Konstantin, Highland Park, IL (US)

(73) Assignee: KONVIN ASSOCIATES, L.P., Lake Forest, IL (US)

( * ) Notice: Subject to any disclaimer, the term of this patent is extended or adjusted under 35 U.S.C. 154(b) by 75 days.

(21) Appl. No.: 13/839,646

(22) Filed: Mar. 15, 2013

(65) Prior Publication Data

US 2014/0174008 A1 Jun. 26, 2014

Related U.S. Application Data

(63) Continuation-in-part of application No. 13/293,901, filed on Nov. 10, 2011, now Pat. No. 8,544,223, which is a continuation of application No. 12/426,129, filed on Apr. 17, 2009, now Pat. No. 8,056,289.

(Continued)

(51) Int. Cl.

| | |
|---|---|
| ***E04D 3/28*** | (2006.01) |
| ***E04D 3/35*** | (2006.01) |
| ***E04C 2/54*** | (2006.01) |

(52) U.S. Cl.

CPC . *E04D 3/28* (2013.01); *E04C 2/543* (2013.01); *E04D 3/35* (2013.01); *E04D 3/352* (2013.01); *E04D 3/355* (2013.01); *E04D 3/357* (2013.01); *E04D 2003/285* (2013.01)

(58) Field of Classification Search

CPC ..... E04C 2/543; E04D 3/28; E04D 3/35; E04D 3/352; E04D 3/355; E04D 3/357; E04D 2003/285

USPC ..... 52/204.591, 204.593, 204.595, 52/204.597, 204.6, 204.62, 204.71, 52/204.72, 209, 302.3, 588.1, 582.1, 549, 52/745.08, 745.16

See application file for complete search history.

(56) References Cited

U.S. PATENT DOCUMENTS

| | | | | |
|---|---|---|---|---|
| 3,363,383 | A * | 1/1968 | La Barge | 52/471 |
| 3,380,210 | A * | 4/1968 | Neal et al. | 52/235 |
| 3,421,276 | A * | 1/1969 | La Barge | 52/287.1 |

(Continued)

FOREIGN PATENT DOCUMENTS

| | | | |
|---|---|---|---|
| DE | 29613495 | U1 | 10/1996 |
| WO | 2010/013233 | A2 | 2/2010 |

OTHER PUBLICATIONS

International Search Report and Written Opinion issued in related application PCT/US2013/060974 dated Dec. 13, 2013, 13 pages.

*Primary Examiner* — Rodney Mintz

(74) *Attorney, Agent, or Firm* — Drinker Biddle & Reath LLP

(57) ABSTRACT

A panel unit with interlocked first and second engagement members each having panel-receiving cavities for receiving and retaining edge portions of panels, two pairs of opposed transparent or translucent panels mounted in the cavities of the first and second engagement members, in which the panel units are subject to positive and negative forces which may cause the engagement members to pivot with respect to each other and the first engagement member has catch rails for engaging sidewalls defining an interlock cavity in the second engagement member to limit the pivoting movement of the engagement members.

46 Claims, 26 Drawing Sheets

Related U.S. Application Data

(60) Provisional application No. 61/045,818, filed on Apr. 17, 2008, provisional application No. 61/704,242, filed on Sep. 21, 2012, provisional application No. 61/736,847, filed on Dec. 13, 2012.

(56) References Cited

U.S. PATENT DOCUMENTS 3,732,659 A * 5/1973 LaBarge ..... 52/461
3,734,550 A * 5/1973 Vance ..... 403/34
3,931,699 A * 1/1976 Sarvay ..... 52/476
4,299,070 A * 11/1981 Oltmanns et al. ..... 52/309.11
4,332,119 A 6/1982 Toews
4,385,850 A 5/1983 Bobath
4,402,168 A * 9/1983 Maier, Jr. ..... 52/478
4,407,105 A 10/1983 Frank
4,555,884 A * 12/1985 van Eerden ..... 52/204.591
4,573,300 A * 3/1986 Bezner ..... 52/563
4,599,838 A * 7/1986 Kaminaga ..... 52/235
4,628,655 A * 12/1986 Scheiderer ..... 52/204.591
4,750,310 A * 6/1988 Holcombe ..... 52/844
4,768,319 A 9/1988 Derner
4,775,570 A * 10/1988 Ohlenforst et al. ..... 428/83
4,790,112 A * 12/1988 Wang ..... 52/460
4,799,344 A * 1/1989 Francis ..... 52/235
4,809,475 A * 3/1989 Emmer ..... 52/235
4,825,609 A * 5/1989 Rundo ..... 52/202
4,840,004 A * 6/1989 Ting ..... 52/235
4,845,912 A * 7/1989 Baker ..... 52/506.09
4,860,517 A * 8/1989 Kipross ..... 52/656.2
4,873,803 A * 10/1989 Rundo ..... 52/202
4,912,895 A * 4/1990 Harris, Jr. ..... 52/208
4,926,594 A * 5/1990 Sampson et al. ..... 52/200
4,998,395 A 3/1991 Bezner
5,018,326 A * 5/1991 Reynolds ..... 52/235
5,076,034 A * 12/1991 Bandy ..... 52/235
5,083,405 A 1/1992 Miller
5,095,676 A * 3/1992 Muhle ..... 52/476
5,163,257 A * 11/1992 Crowell ..... 52/200
5,212,914 A 5/1993 Martin et al.
5,253,459 A * 10/1993 Parinas et al. ..... 52/235
5,283,992 A * 2/1994 Morassutti ..... 52/509
5,348,790 A * 9/1994 Ben-Zvi et al. ..... 428/178
5,381,637 A 1/1995 Farag
5,423,157 A * 6/1995 Watanabe ..... 52/745.08
5,448,865 A * 9/1995 Palmersten ..... 52/309.9
5,452,552 A * 9/1995 Ting ..... 52/235
5,469,683 A * 11/1995 McKenna et al. ..... 52/204.591
5,481,839 A * 1/1996 Lang et al. ..... 52/235
5,491,943 A * 2/1996 Vondrejs et al. ..... 52/239
5,584,155 A 12/1996 Watanabe
5,592,795 A 1/1997 Rinehart et al.
5,598,671 A * 2/1997 Ting ..... 52/235
5,622,017 A * 4/1997 Lynn et al. ..... 52/209
5,644,878 A * 7/1997 Wehrmann ..... 52/287.1
5,647,184 A * 7/1997 Davis ..... 52/592.1
5,678,383 A 10/1997 Danielewicz
5,749,184 A * 5/1998 McKann ..... 52/204.1
5,845,446 A 12/1998 Funaki et al.
5,845,447 A * 12/1998 Bodine et al. ..... 52/506.09
5,901,528 A * 5/1999 Richardson ..... 52/783.1
5,966,888 A * 10/1999 Richardson ..... 52/580
6,016,632 A * 1/2000 McGee et al. ..... 52/241
6,023,899 A * 2/2000 Mecozzi ..... 52/396.04
6,101,777 A * 8/2000 Bodine et al. ..... 52/506.06
6,105,973 A * 8/2000 Butler et al. ..... 277/644
6,122,879 A * 9/2000 Montes ..... 52/592.1
RE36,976 E 12/2000 Bezner
6,164,024 A 12/2000 Konstantin
6,202,382 B1 * 3/2001 Conterno ..... 52/762
6,260,321 B1 7/2001 Rudduck
6,298,627 B1 * 10/2001 Richardson ..... 52/582.1
6,330,772 B1 * 12/2001 Mitchell et al. ..... 52/235
6,347,495 B1 * 2/2002 Conterno ..... 52/483.1
6,360,498 B1 * 3/2002 Westphal ..... 52/204.5
6,412,240 B1 * 7/2002 Treleven et al. ..... 52/208
6,536,175 B2 * 3/2003 Conterno ..... 52/489.1
6,662,512 B2 12/2003 Westphal
6,711,870 B1 * 3/2004 Richardson ..... 52/775
6,715,245 B2 * 4/2004 Lewkowitz ..... 52/208
6,792,730 B2 * 9/2004 Richardson ..... 52/586.2
6,807,779 B1 * 10/2004 Hocker et al. ..... 52/209
6,845,592 B2 * 1/2005 Voegele ..... 52/466
6,959,517 B2 11/2005 Poddany et al.
6,968,661 B2 * 11/2005 Kopish et al. ..... 52/489.1
7,080,488 B2 * 7/2006 Hocker et al. ..... 52/235
7,096,640 B1 * 8/2006 Chevian et al. ..... 52/204.591
D533,950 S * 12/2006 Givoni ..... D25/138
7,168,213 B2 * 1/2007 Rudduck et al. ..... 52/235
7,281,353 B2 * 10/2007 Konstantin ..... 49/82.1
7,313,893 B2 * 1/2008 Voegele, Jr. ..... 52/461
D565,199 S * 3/2008 Westphal ..... D25/122
7,441,379 B2 * 10/2008 Konstantin ..... 52/200
7,546,708 B2 * 6/2009 Konstantin ..... 52/200
7,562,504 B2 7/2009 Herbst et al.
7,578,104 B2 * 8/2009 Rinehart et al. ..... 52/204.593
7,594,364 B2 9/2009 Rinehart et al.
7,614,191 B2 * 11/2009 Mitchell ..... 52/235
7,621,084 B2 * 11/2009 Bilge ..... 52/235
7,661,237 B2 * 2/2010 Jakob-Bamberg et al. ..... 52/506.08
7,694,478 B2 * 4/2010 Zahner ..... 52/302.3
7,748,186 B2 * 7/2010 Voegele, Jr. ..... 52/466
7,765,760 B2 8/2010 Konstantin
7,810,284 B2 * 10/2010 Murphy et al. ..... 49/380
7,823,346 B2 11/2010 Lang
7,823,833 B2 11/2010 Wood
7,832,160 B2 11/2010 Farag
7,841,139 B2 * 11/2010 Dampierre ..... 52/204.68
7,845,120 B2 * 12/2010 Thome et al. ..... 52/144
7,862,103 B2 * 1/2011 Riley et al. ..... 296/186.1
7,866,111 B2 * 1/2011 Johansson ..... 52/588.1
7,926,236 B2 4/2011 Konstantin
7,975,432 B2 * 7/2011 Morton et al. ..... 49/246
8,056,289 B1 11/2011 Konstantin
8,104,239 B2 * 1/2012 Fath ..... 52/173.3
8,127,507 B1 * 3/2012 Bilge ..... 52/235
8,316,598 B2 11/2012 Flynn et al.
8,316,609 B2 11/2012 Ben-Zvi
8,375,670 B2 * 2/2013 Hysky ..... 52/506.06
8,544,223 B1 * 10/2013 Konstantin ..... 52/204.591
8,621,793 B2 * 1/2014 Abdul Lathief ..... 52/204.66
9,010,056 B2 * 4/2015 Ben David ..... 52/466
2001/0005963 A1 * 7/2001 Richardson ..... 52/465
2001/0029708 A1 * 10/2001 Richardson ..... 52/57
2003/0019178 A1 * 1/2003 Wang Chen ..... 52/455
2003/0089054 A1 * 5/2003 Hornung ..... 52/204.62
2003/0188498 A1 * 10/2003 Lewkowitz ..... 52/208
2003/0205009 A1 11/2003 Herbst et al.
2003/0213202 A1 * 11/2003 Hutchings et al. ..... 52/578
2003/0230034 A1 * 12/2003 Lapierre ..... 52/204.5
2004/0020150 A1 * 2/2004 Fensel et al. ..... 52/468
2004/0068942 A1 * 4/2004 Krochmal et al. ..... 52/204.71
2004/0221526 A1 11/2004 Rinehart et al.
2004/0256000 A1 12/2004 Konstantin
2004/0261336 A1 12/2004 Konstantin
2006/0096224 A1 * 5/2006 Asbury ..... 52/582.1
2006/0185273 A1 8/2006 Lathief
2007/0131273 A1 6/2007 Kobayashi
2008/0010919 A1 * 1/2008 Tufts et al. ..... 52/204.591
2008/0016800 A1 * 1/2008 Tufts et al. ..... 52/204.6
2008/0134594 A1 * 6/2008 Ness ..... 52/200
2008/0134610 A1 * 6/2008 Jakob-Bamberg et al. .. 52/489.1
2008/0202055 A1 * 8/2008 Boda ..... 52/582.1
2008/0216424 A1 * 9/2008 Westphal et al. ..... 52/204.5
2009/0049770 A1 * 2/2009 Konstantin ..... 52/200
2009/0049771 A1 * 2/2009 Konstantin ..... 52/200
2009/0113826 A1 5/2009 Abdul Lathief
2009/0241466 A1 * 10/2009 Gussakovsky ..... 52/786.1
2009/0293241 A1 * 12/2009 Voegele, Jr. ..... 24/457
2010/0126099 A1 * 5/2010 Ben-Zvi ..... 52/582.1
2010/0132293 A1 * 6/2010 Voegele et al. ..... 52/402
2010/0212238 A1 8/2010 Voegele, Jr. et al.
2010/0242397 A1 9/2010 Givoni et al.

(56) References Cited

U.S. PATENT DOCUMENTS

| | | | | |
|---|---|---|---|---|
| 2010/0287858 | A1 | 11/2010 | Israeli et al. | |
| 2011/0016823 | A1* | 1/2011 | Wood | 52/745.16 |
| 2011/0138727 | A1* | 6/2011 | Labrecque | 52/483.1 |
| 2011/0179735 | A1* | 7/2011 | Paetrow et al. | 52/309.1 |
| 2011/0179739 | A1 | 7/2011 | Konstantin | |
| 2011/0185667 | A1* | 8/2011 | Carter | 52/506.05 |
| 2011/0197535 | A1* | 8/2011 | Baker et al. | 52/588.1 |
| 2011/0252731 | A1* | 10/2011 | Boyer et al. | 52/302.1 |
| 2012/0151867 | A1 | 6/2012 | Smith et al. | |
| 2013/0097952 | A1* | 4/2013 | Flynn et al. | 52/309.1 |
| 2013/0283710 | A1* | 10/2013 | Laurin et al. | 52/173.3 |
| 2013/0287489 | A1* | 10/2013 | Laurin et al. | 403/361 |
| 2014/0112698 | A1* | 4/2014 | Ben David | 403/28 |
| 2014/0115982 | A1* | 5/2014 | Abdul Lathief | 52/208 |
| 2014/0166665 | A1* | 6/2014 | McNamara | 220/565 |
| 2014/0318050 | A1* | 10/2014 | Lathief | 52/204.595 |

* cited by examiner

DUAL GLAZING PANEL SYSTEM

CROSS-REFERENCE TO RELATED PATENT APPLICATIONS

This patent application is a continuation-in-part of copending U.S. patent application Ser. No. 13/293,901, filed Nov. 10, 2011, which is a continuation of U.S. patent application Ser. No. 12/426,129, filed Apr. 17, 2009 now issued as U.S. Pat. No. 8,056,289, and also claims the benefit of U.S. Provisional Patent Applications No. 61/704,242, filed Sep. 21, 2012 and No. 61/736,847, filed Dec. 13, 2012.

FIELD OF THE INVENTION

Embodiments pertain to modular upstanding seam flange glazing panels and other glazing panels for architectural structures and, more particularly, to systems for assembling such modular upstanding seam flange panels and other panels into unique paired glazing panel units having an airspace between the panels and the ability to operate under substantial positive and negative panel loads, to methods for attaching the panel units together and installing the units in sloped glazing, skylights, roofs, walls, and other architectural structures in ways not heretofore possible, including in curved or radiused structural configurations, and to new systems for supporting and attaching the panel units to supporting members.

BACKGROUND

Extruded modular panels with upstanding seam flanges as well as generally flat panels made of polycarbonate and other resins including fiberglass are widely used in the design of various architectural structures because they are a strong, lightweight alternative to traditional materials, like glass, which they often replace. For example, such modular glazing panels can be joined along flat panel edges or along upstanding seam flanges that extend along their edges to form glazing panel units that can be used either alone or with a supporting framework of, e.g., purlins or rafters, to form overhead, wall, or roofing structures. The ability of such panel units to transmit light has made them particularly useful where it is desired to allow sunlight to pass into a structure such as to illuminate an interior region of a building. An additional advantage of these panel units is that they have good energy conservation and sound insulation characteristics. The glazing panel units also have greater structural strength than single panels making them useful in applications where single panels could not be used or would require additional supporting structural elements.

The extruded modular panels with upstanding seam flanges as well as generally flat panels made of polycarbonate and other resins may be, e.g., up to 45 feet in length, 2-6 feet wide and typically are flexible. It therefore requires substantial skill and is time-consuming to assemble and install the panels into glazing panel units on-site. The challenge to assembling and installing the panel units faced by such skilled workers can be appreciated, for example, by examining FIGS. 1A and 1B which illustrate representative prior art panel pair assembly systems.

More particularly, FIG. 1A shows a purlin 1 and one of a series of metal retaining clips 2 spaced and affixed along the purlin. The retaining clips include horizontal flanges 3. Once the series of spaced retaining clips are in place on the purlin (or other supporting member), polycarbonate (or other resin) bottom modular panels 4A and 4B are manipulated into position and slid horizontally under the flanges of the retaining clips. Then, an elongated resilient batten joint connector 5 with a downwardly facing elongated bottom cavity 6A is forced down over the upstanding seam flanges 7A and 7B of modular panels 4A and 4B to lock them onto the retaining clips by way of sawteeth in the bottom cavity that mate with sawteeth on the flanges of the bottom panels. Finally, top modular panels 8A and 8B are manipulated into position with their seam flanges 9A and 9B aligned with the upwardly facing elongated top cavity 6B in the batten joining connector and pressed into place with the sawteeth of flanges 9A and 9B of modular panels 8A and 8B held in place by corresponding sawteeth within cavity 6B.

FIG. 1B shows juxtaposed panel units (or "insulated translucent sandwich panels") 11 each comprising top and bottom generally flat fiberglass panels 13 and 15 with a grid made of up of vertically and/or horizontally disposed metal or resin grid members 19 (only one shown) located in the space between the panels and in abutment with the panels. The grid serves to, inter alia, maintain the spacing between the panels. The "fiberglass" from which panels 13 and 15 are made is a fiber-reinforced polymer made of a resin matrix reinforced by glass fibers. The resin used in the fiberglass may be a polyester, an epoxy, a thermosetting plastic or thermoplastic. Shelf supports 21 located at the top and bottom of the grid members are affixed to panels 13 and 15 by adhesive which is located in the interstices between the shelf members and the inner faces 23 and 25 of the top and bottom panels to form glazing panel units. Finally, adjacent insulated sandwich panel units are laterally attached using a clamp 27 comprising a bottom support 29 and a top support 31. In order to lock the adjacent sandwich panel units together, a screw 33 is passed through the bottom clamp support and screwed home in a receptacle 35 that projects downwardly from the top clamp support to lock down the clamp. The attachment of the grid to the panels as well as the onsite lateral attachment of adjacent sandwich panels, as in the case of the modular panels of FIG. 1A, is time-consuming and requires substantial skill.

While there are many known variations on the prior art panel unit systems of FIGS. 1A and 1B, they are indicative of the relative complexity of assembling and installing sloped glazing, skylights, roofs, walls and other architectural structures having paired panel units on-site.

The system of FIG. 1A also illustrates the conventional metal (retaining clip) to resin skin (flange of panel) contact employed in current modular upstanding seam panel retention systems. Because those skilled in this art have been wed to fixing the panels in place through such direct engagement of an unforgiving hard or high ultimate tensile strength metal retention clip against the resilient low ultimate tensile strength resin skin of the polycarbonate modular panel, it has been necessary to take extra steps to ensure that load specifications are met. For example, skin weight of modular panel flanges is greater than it otherwise would need to be in order to prevent cracking of the polycarbonate or other resin skin of the panel flanges under load. This excess weight results in unnecessary material usage/cost and reduced light transmission. Also, large numbers of closely spaced retention clips are often required to meet wind load and other load specifications by spreading out the load across more clips also to prevent cracking of the resin skin of the flanges under load, again leading to increased weight and material and labor waste.

FIG. 1C illustrates a prior art system which does not entail the use of prior prepared modular panel units. Rather, lower panels are fixed in place after which spacers are applied and top panels attached to the spacers. Most significantly, locking clips 714 must be located between the lower panels at regular intervals along the panels. Since the system does not include the metal armoring or cladding feature of the present invention, support members to which the clips are attached must be positioned at relatively close intervals to receive fasteners in the clips and support the panels.

There is therefore a great need for a system that makes it easier and less time-consuming to assemble and install or erect paired glazing panel units. If such a system also provided a completed architectural glazing structure comprised of glazing panel units made up of modular upstanding seam flange panels or flat resin panels which is safe, secure, strong and able to withstand substantially increased negative and positive wind and snow loads, a particularly unexpected and useful contribution to the art would be at hand. If such a system further eliminated the inherent limitations of conventional metal-to-resin engagement, required fewer retention clips, and made it possible to reduce panel thickness, an extremely important and unexpected advance in the art would be in the offing.

Present embodiments provide systems for readily assembling pairs of such glazing panels into glazing panel units either on-site (but typically in convenient ground level work areas) or off-site, and then readily installing the pre-assembled panel units on-site to erect the sloped glazing, skylights, roofs, walls, and other architectural structures.

These new systems are particularly elegant in that they armor or metal clad the standing seams of the modular panels and the flat panel edges to thereby provide a unique new retention that withstands increased wind and snow loads while making it possible to reduce the thickness and weight of the flat panels or the resin skin of the flanges of the modular panels and optionally to use thinner and lighter bottom or inner panels. These new systems are also surprisingly economical in terms of materials (e.g., the number of retention clips can be reduced and modular panels with thinner and hence less expensive resin skins and thinner flat resin panels can be used) and in terms of construction costs since they can be erected quickly and generally without special skills, and produce architectural structures that can accommodate longer spans, are surprisingly effective in limiting air, water and sound infiltration, and have outstanding energy conservation characteristics. Indeed, the present systems make it possible to readily insert infill into the airspace between the panels off-site (or on-site) in the form of translucent insulation (e.g., glass fiber), or to add metal screening to flat panel glazing units enhancing the fire resistance of the panel units and helping to resist severe localized impacts on the outer panels of the units. This is another welcome improvement since it is extremely difficult and expensive to add infill or metal grids to prior art panel units which must be assembled on-site.

Finally, it is important to accommodate horizontal expansion and contraction of the glazing panel units. While prior systems for assembling and installing panel pairs have a limited ability to accommodate such expansion and contraction, the use of the interlocking first and second locking engagement members of present embodiments accommodates such horizontal expansion and contraction far better than earlier designs and in a way not contemplated by those skilled in this art.

SUMMARY

An embodiment comprises a modular upstanding seam flange glazing panel unit. The panel unit has opposed transparent or translucent elongated top and bottom modular upstanding seam flange panels with corresponding elongated upwardly and downwardly directed flanges and an airspace between the panels. The seam flanges are disposed at opposite lateral edges of the modular panels. Interlocking metal first and second locking engagement member designs are provided, having upwardly and downwardly disposed cavities for receiving and retaining corresponding upwardly and downwardly directed flanges of the panels. The panel flanges each have sawteeth and the cavities of the interlocking metal first and second locking engagement members have corresponding sawteeth that engage and lock onto the panel flanges.

In other embodiments, glazing panel units are provided comprising opposed transparent or translucent generally flat resin panels. Corresponding first and second metal locking engagement members are applied along the lateral edges of each of the resin panels either with adhesive or in a press-fit structure that captures and armors or metal clads the lateral edges of the resin panels. As a result, the panel units can be aligned laterally so that the corresponding first and second metal locking engagement members can be interlocked on-site in a convenient and secure manner.

When two glazing panel units are interlocked, the metal first and second locking engagement members of the two adjoining laterally disposed panel units may form an air cavity and an internal gutter for collecting and draining away any water that infiltrates past the opposed lateral edges of the panel units to enhance moisture management of the system. In embodiments, a guide member projects from a first locking engagement member and is received in a walled cavity in a second locking engagement member. Also, preferably either the second locking engagement member, the first locking engagement member, or both may include a resilient member sized and positioned to sealingly engage the guide member when the first and second engagement members are interlocked.

In other embodiments, a first locking engagement member includes a guide member having a generally downwardly directed nub and a second locking engagement member includes a walled cavity for receiving the guide member with a corresponding generally upwardly directed nub on a wall of the cavity. The upwardly directed nub on the wall of the cavity is positioned to engage the nub on the guide member as the first and second locking engagement members are moved into interlocking position.

Other embodiments comprise architectural structures for passing sunlight into interior regions of a building while limiting the infiltration of water, air and sound. At least two transparent or translucent glazing panel units are provided comprising either opposed top and bottom modular panels with corresponding elongated upwardly and downwardly directed flanges or flat panels made of polycarbonate and other resins and an airspace between the panels. Interlocking metal first and second locking engagement members are disposed respectively at the opposite modular panel flanges or at the lateral edges of the flat panels and attached to supporting structure.

The modular panel skins and flat panels have substantially lower ultimate tensile strength than the ultimate tensile strength of the interlocking metal first and second locking engagement members. In erecting the panel unit structure, a first panel unit having a locking engagement member is disposed opposite the corresponding locking member of a second panel unit and interlocked therewith. Preferably at least one of the corresponding locking engagement members is first affixed to a supporting structure by retaining clips. Embodiments also include retaining clip and locking engagement member designs in which the clips do not extend into the interstice between adjacent panel units to thereby produce a gap-free assembly enhancing sound, moisture and air sealing.

In other embodiments modular panels of the architectural structure include resilient areas along their lateral edges. These resilient areas accommodate lateral expansion and contraction of the modular panels in conjunction with the interlocking locking engagement members to help control air, water and sound infiltration when the panel units are interlocked and to avoid buckling of the panels as a result of lateral panel expansion.

Other embodiments comprise methods of erecting architectural structures for passing sunlight into an interior region of a building while limiting the infiltration of water, air and sound. The method includes assembling together at least two transparent or translucent modular upstanding seam flange having opposed elongated top and bottom modular panels with corresponding elongated upwardly and downwardly directed flanges or flat panel edges and an airspace disposed between the panels. When modular panels with seam flanges disposed at or near opposite lateral edges of the panels are used, interlocking metal first and second locking engagement members each having upwardly and downwardly disposed cavities are attached respectively to the corresponding upwardly and downwardly directed flanges at the opposite lateral edges of the modular panels. Finally, for both modular and flat panel units the corresponding first and second locking engagement members are interconnected to complete the architectural structure. In a preferred embodiment, at least one of the corresponding first and second locking members is affixed to the supporting structure.

In further embodiments, engagement members are provided that enable the erection of radiused or curved panel structures.

BRIEF DESCRIPTION OF THE DRAWINGS

In order to aid in understanding the invention, it will now be described in exemplary embodiments it will now be described with reference to the accompanying drawings in which like numerical designations will be given to like features with reference to the accompanying drawings wherein.

DETAILED DESCRIPTION OF PREFERRED EMBODIMENTS

Figure 1A:
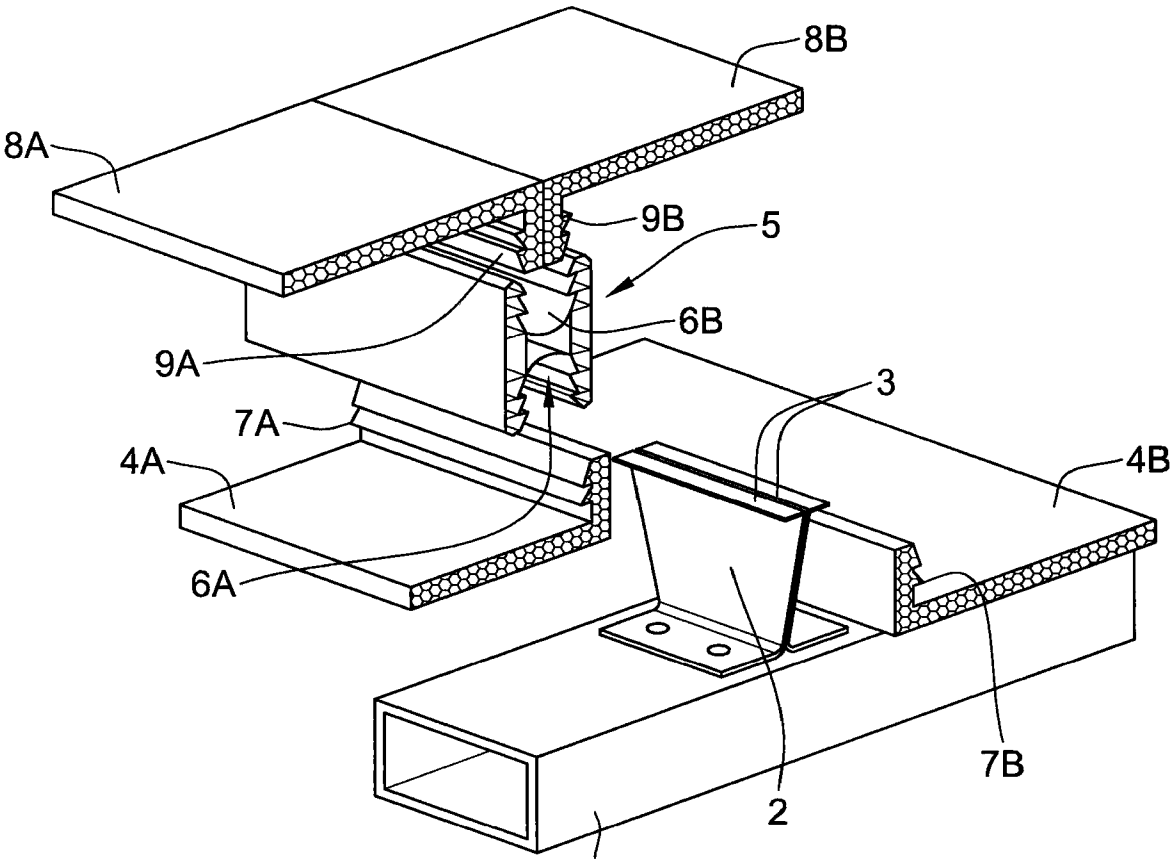
FIG. 1A PRIOR ART
FIGS. 1A and 1B are a partial exploded perspective views of prior art flat and modular panel pair assembly and installation system.
Figure 1B:
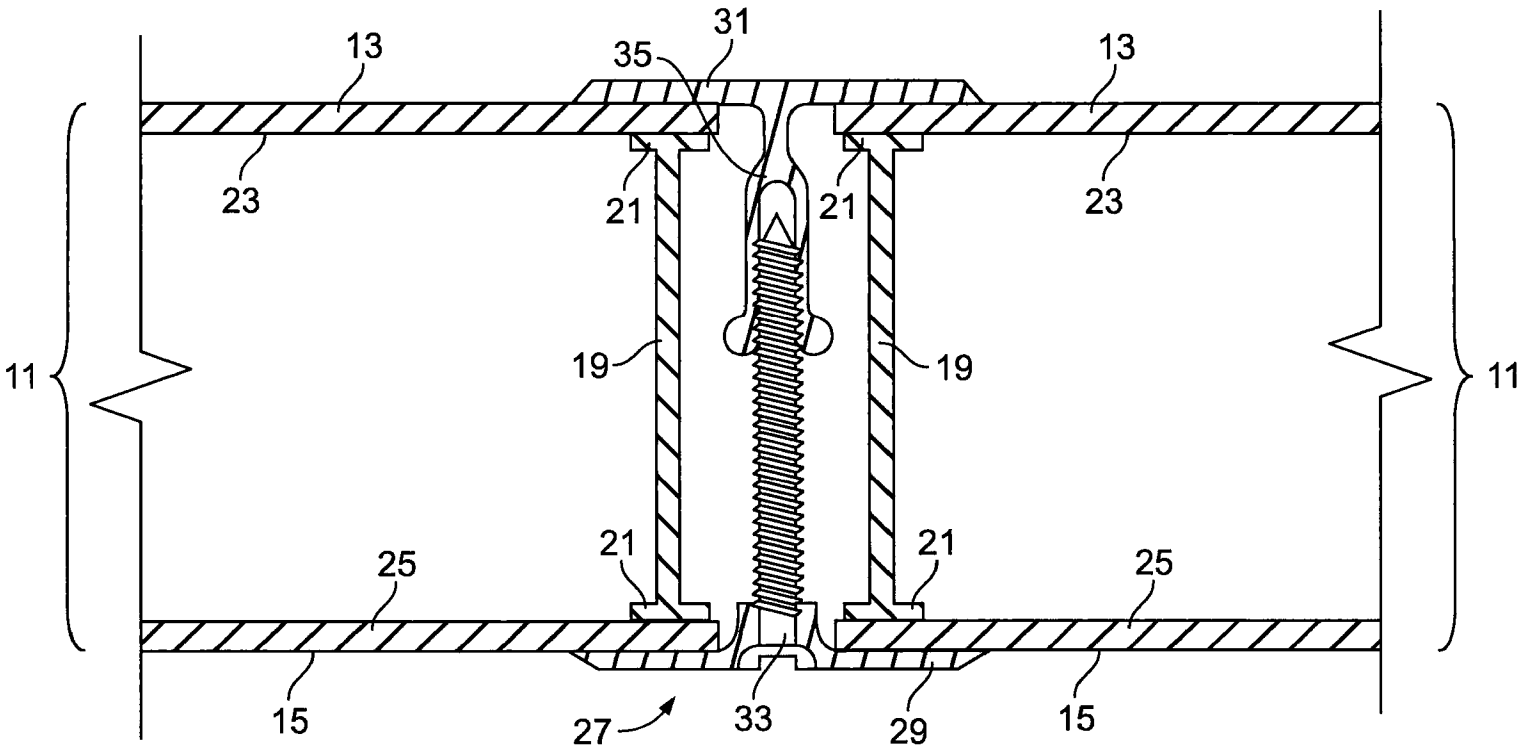
FIG. 1B PRIOR ART
Figure 1C:
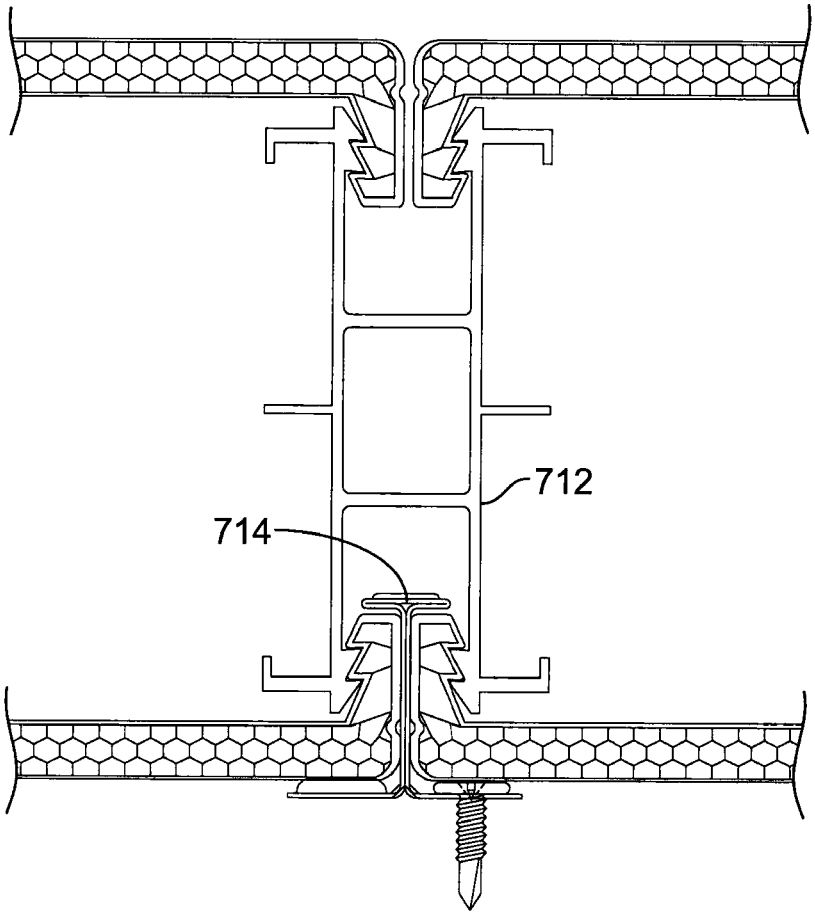
FIG. 1C PRIOR ART
FIG. 1C is a prior art system that does not include the metal armoring or cladding feature of the present invention.
Figure 2:
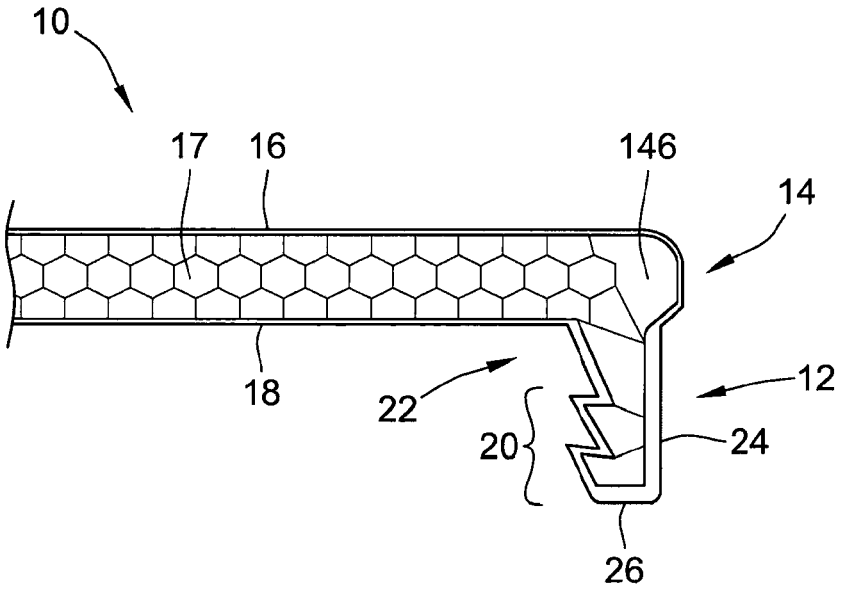
FIG. 2 is a sectional view of a portion of a modular upstanding seam flange panel.

Turning now to FIG. 2, a single modular upstanding seam flange panel 10 is shown in cross-section, with a seam flange 12 at its distal end 14. The seam flange preferably extends along or adjacent the entire length or lateral edge of the panel which may be, for example, up to 45 feet in length and from 2 to 4 feet in width. A second flange will be located along the opposite edge of the modular panel parallel to flange 12. Of course, the panels may be provided in other sizes if desired.

Modular panel 10 may be extruded from polycarbonate (or other resin) and may have a plurality of internal cells in a honeycomb configuration 17 (or other configuration) disposed in the interior of the panel between its outer surface 16 and its inner surface 18. Modular panels 10 with this upstanding seam flange design are known in the art and described for example in U.S. Pat. No. 6,164,024, which is incorporated by reference for purposes of describing the panels and installations in which they may be used. Modular panels with upstanding seam flanges of the design shown in FIG. 2 and modified versions thereof that function generally in the same fashion, made of polycarbonate or other resins, will be referred to herein as "modular panels," "modular upstanding seam flange panels," etc.

The preferred honeycomb cell configuration 17 of modular glazing panels 10 helps control the panel thermal expansion in all directions and gives it resistance to impact and wind and snow loading while maintaining superior light-diffusion capabilities. Particularly desirable modular panels 10 are available from CPI Daylighting, Inc., 28662 Ballard Drive, Lake Forest, Ill. 60045 as PENTAGLAS® NANO-CELL® architectural panels.

Upstanding seam flanges 12 have a series of sawteeth 20 along their inner surface 22 and generally will be flat along their outer surface 24 optionally with a protruding open resilient bubble corner area 146 to improve sealing between adjacent panels as will be discussed below. The surface 26 of the flanges (at the top or bottom of the flanges depending on how the flange is oriented in the panel unit) may also be flat. Additionally, preferably the flanges also include internal cells to give them enhanced strength, resilience, and expansion/contraction properties as described above. Other modular panel designs will be addressed below. In all cases the modular panels have a thin low ultimate tensile strength skin which runs along the entire surface of the panel.

Figure 3A:
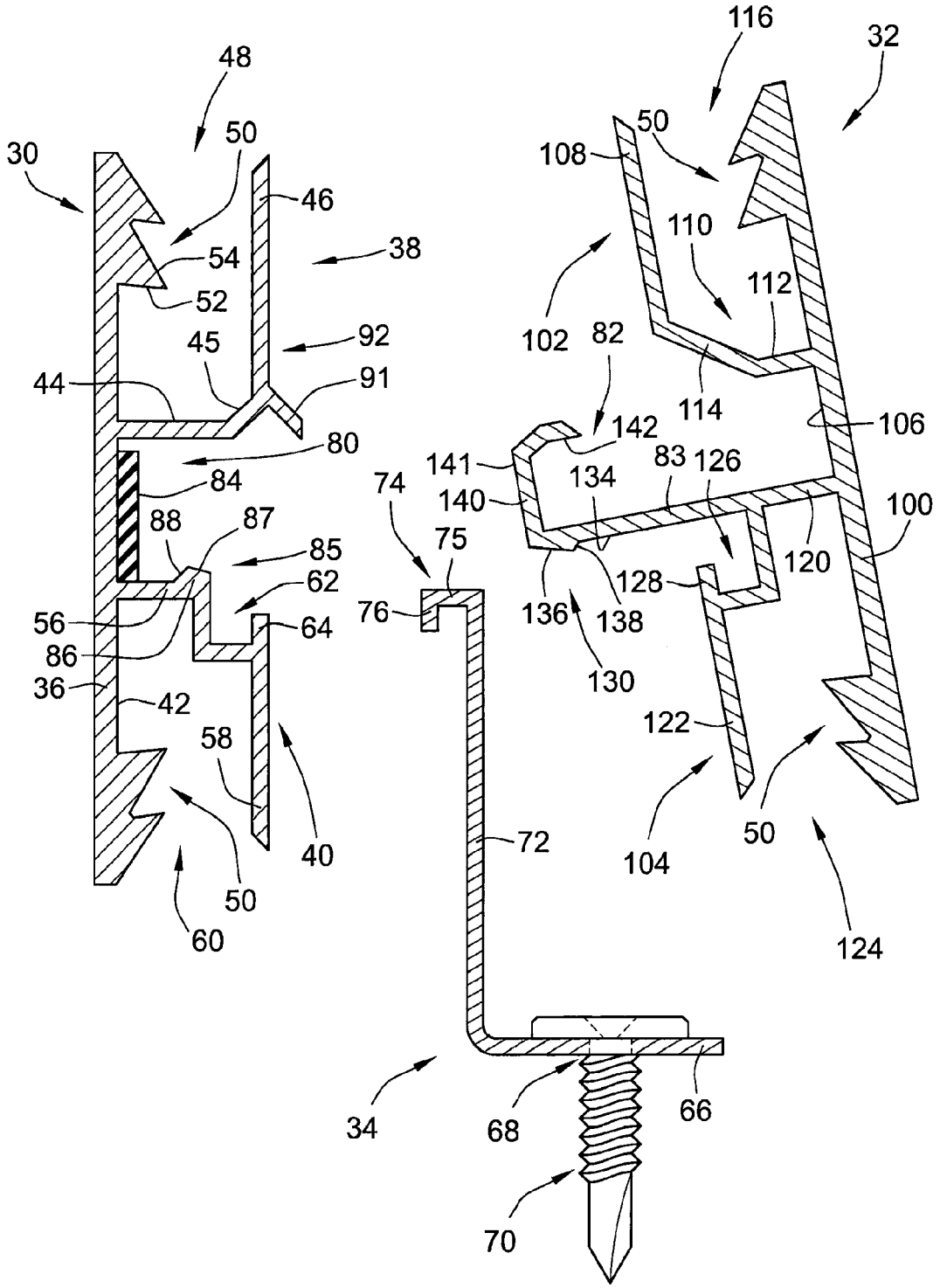
FIGS. 3A and 3B are elevation views taken respectively at ends of first and second locking engagement members before and after they are interlocked.
Figure 3B:
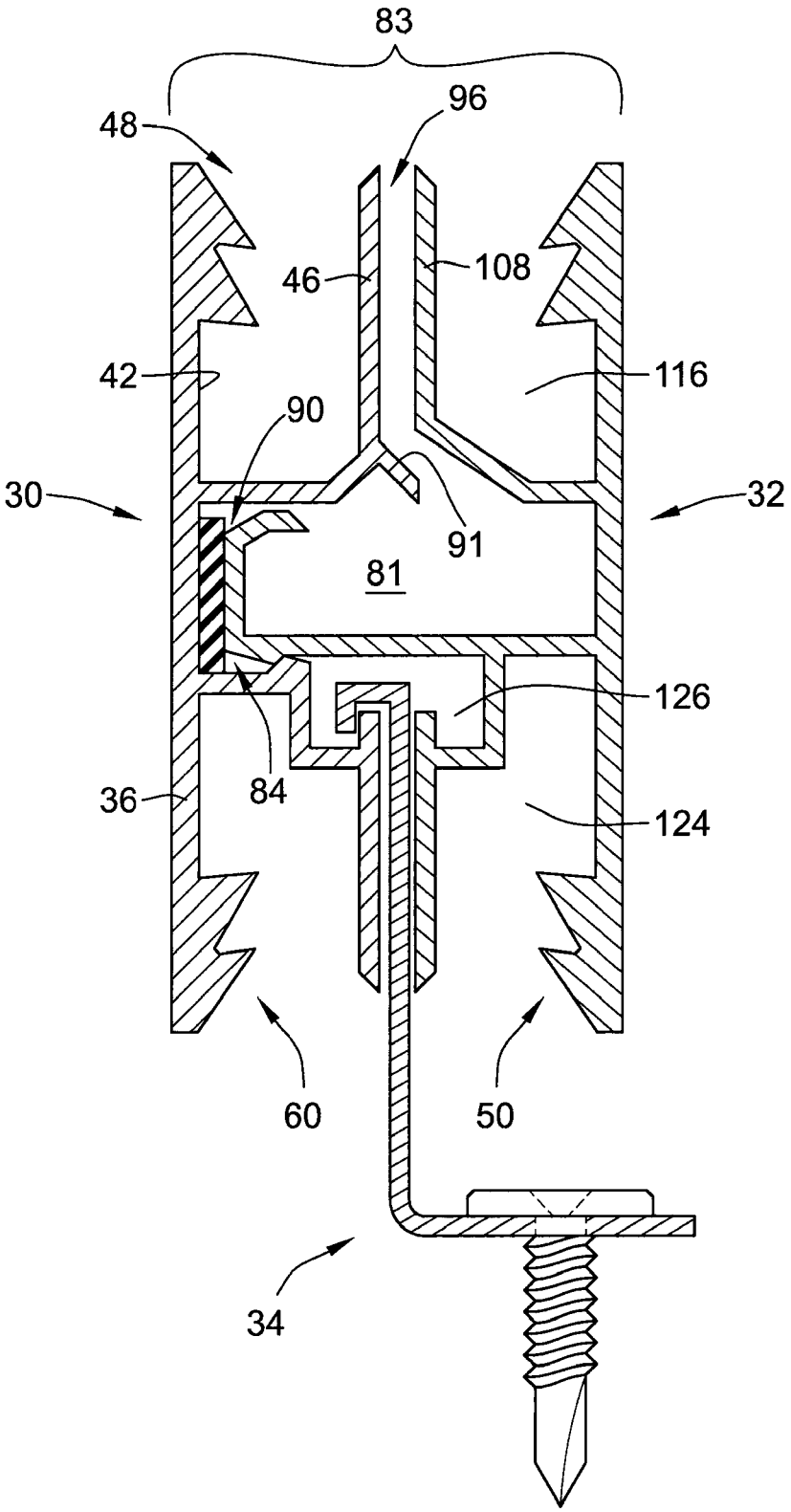

In accordance with one embodiment of the invention for use with modular panels, FIG. 3A shows a second locking member 30 and its corresponding first locking member 32 and a metal retention clip 34 juxtaposed between the two locking members. Members 30 and 32 are designed to interlock as illustrated in FIG. 3B. Both locking members may be made, for example, as aluminum extrusions and are each configured for attachment to upstanding seam flanges 12 of corresponding pairs of modular panels to construct a glazing panel unit while armoring or cladding the seam flanges with high tensile strength metal to thereby strengthen and stiffen the panel edges and prevent damage at the points of attachment of retention clips 34. When metal retention clips are used, a particularly desirable metal-to-metal engagement is achieved. However, the locking members alternatively may be made of engineered plastics, pultruded fiberglass, metal plast, or other appropriate high ultimate tensile strength materials to armor or clad the seam flanges (or panel edges in the embodiments of FIGS. 25-26) with this high tensile strength material.

The armoring or cladding of the skin of the modular panel flanges by the metal of the locking members protects the flanges (and the panels) from damage at the points of contact by the retention clips and elsewhere that might otherwise occur due to loading and stresses from wind or snow loads and panel expansion and contraction. It also increases the strength of the entire glazing panel unit, making it possible to reduce the weight of the skin of the two panel flanges and to use the glazing panel unit across spans and in other applications in which conventional panel units could not be used without additional retention clips and structural support. Indeed, unlike conventional systems where the bearing load is sustained primarily by the bottom or inner panel, in present embodiments the load is sustained primarily by the first and second engagement members and the top or outer panel so an overall lighter skinned bottom or inner modular panel can be used.

Figure 4B:
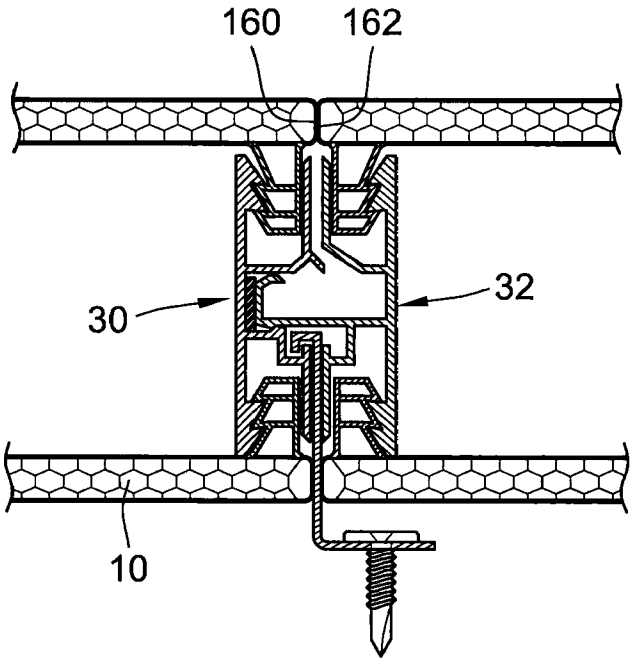
FIGS. 4A and 4B respectively correspond to FIGS. 3A and 3B but modular panels are shown installed in the first and second locking engagement members of adjoining panel units.

In FIG. 3A, second locking member 30 is disposed vertically (as it would be, e.g., at rest in a horizontal roof or skylight installation) and first locking member 32 is angled with respect to the second locking member to correspond to the orientation of the locking members during the course of an on-site or erection process which concludes with the panel units installed in the juxtaposed arrangement of, e.g., FIG. 4B. Alternatively, the glazing panel units may be installed by directly aligning them rather than angling one of the panels and sliding the two panel units laterally together until the locking members are fully engaged or interlocked.

Second locking member 30 includes a base 36 which is oriented vertically in the figure and generally U-shaped upwardly and downwardly directed arms 38 and 40 which depend from the back surface 42 of the base. Arm 38 includes a generally flat horizontal portion 44 and a generally flat vertical portion 46. Horizontal portion 44 includes an optional angled outer corner portion 45 to enhance the resilience and resistance to breakage of arm 38 at this corner. The back surface of the base and the U-shaped arm together define an upwardly directed cavity 48 for receiving and locking onto the flange of the top modular panel of glazing panel unit 142 illustrated in FIGS. 4A and 4B. Finally, at least one sawtooth and preferably at least two sawteeth 50 (as shown) project from back surface 42 into cavity 48 to engage sawteeth 20 on upstanding flange 12 of panel 10 in the assembly of the modular panels onto locking member 30. Sawteeth 50 include horizontal portions 52 and angled portions 54 which are angled and dimensioned to engage sawteeth 20 of the modular panel flange.

In a like manner, downwardly directed U-shaped arm 40 includes a generally horizontal portion 56 and a vertical portion 58. The horizontal and vertical portions define a downwardly directed cavity 60 which will engage the upstanding flange of a second panel of the modular panel unit assembled on locking member 38. Horizontal portion 56 may be stepped downwardly, as shown, to produce a slot 62 having an upwardly directed lip 64 for receiving engagement hook 74 of retention clip 34 and achieving a metal-to-metal retention of the panels and panel unit. Other alternative structural arrangements for engagement between the retention clip and the locking member may be used and the engagement members may alternatively be made of engineered plastics, pultruded fiberglass, metal plast, or other appropriate high ultimate tensile strength materials.

Retention clip 34 includes a base 66 with a hole 68 for receiving a fastener 70 which will be driven or screwed into a purlin, rafter or other support (not shown) to hold adjoining juxtaposed glazing panel units (e.g., units 142 and 144 of FIG. 4B) in place. Base 66 supports an upstanding wall 72 and an engagement hook 74. The hook includes a ledge 75 and a downwardly directed lip 76 dimensioned to fit within slot 62 (or 126) and engage the inner surface of locking member lip 64 to retain second locking member 30 and the adjoining interlocked first locking member and their modular panels/glazing panel units in place during the on-site erection of the desired sloped glazing, skylights, roofs, walls, and other architectural structures from series of juxtaposed panel units. However, in short span applications the panel units may be interconnected and erected in place without the use of retention clips.

Horizontal portions 44 and 56 of upwardly and downwardly directed arms 38 and 40 are spaced from each other to define or wall in a horizontally directed inner cavity 80. Inner cavity 80 receives a guide member 82 of first locking member 32 and in doing so helps form an inner gutter 81 (FIG. 3B) in the final interconnected locking member pair 83, which will be discussed in more detail below. The guide member helps resist loads on the interconnected engagement members and so must be strong and long enough to accommodate the maximum expected load on the interconnected engagement members.

Preferably a resilient sealing strip 84 will be positioned in cavity 80 along the back surface 42 of base 36 in horizontally directed inner cavity 80 to engage guide member 82. This establishes a gutter seal 90 as illustrated in FIG. 3B to help achieve and maintain a water- and air-tight condition in inner gutter 81 while also enhancing the soundproofing properties of the final interconnected locking member pair 83. Inner gutter 81 in turn carries the water to an open end of the interconnected locking members where a sill and appropriate flashing will be provided to collect escaping water and to carry it away from the slopped glazing, skylight, roof, wall or other architectural structure.

Also, top corner 85 of step portion 62 may have a nub 86 with front and back inclined surfaces 87 and 88 which facilitate the interlocking process as will be described below. Finally, an optional water rail 91 projects down and away from the outer surface 92 of vertical portion 46. As will be discussed further below, this rail directs any water that infiltrates or is drawn down between the adjacent top panels of juxtaposed panel units and moves down surface 92 due to surface tension effects or through the gap 96 between vertical portions 46 and 108 away from gutter seal 90 to minimize the likelihood that such infiltrating water will find its way to the gutter seal.

Turning now to first locking member 32 in FIG. 3A, it is seen that this locking member has a base 100 and U-shaped upwardly and downwardly directed arms 102 and 104 which depend from the back surface 106 of the base. Arm 102 includes a generally flat vertical portion 108, and a bottom 110 made up of a first flat portion 112 generally perpendicular to base 100 and a second upwardly angled flat portion 114. This bottom configuration is chosen to enhance the resilience and resistance to breakage like the corner on arm 38 described above and is, of course, optional. Back surface 106 of base 100 and U-shaped arm 102 together define a generally upwardly directed cavity 116 for receiving the downwardly directed flange of a top modular glazing panel of a glazing panel unit. Finally, sawteeth 50 project from back surface 106 into cavity 116 to engage sawteeth 20 on upstanding flange 12 of a modular panel 10. Sawteeth 50 include horizontal and angled portions that are dimensioned to engage sawteeth 20 of the modular panel flange.

Figure 4A:
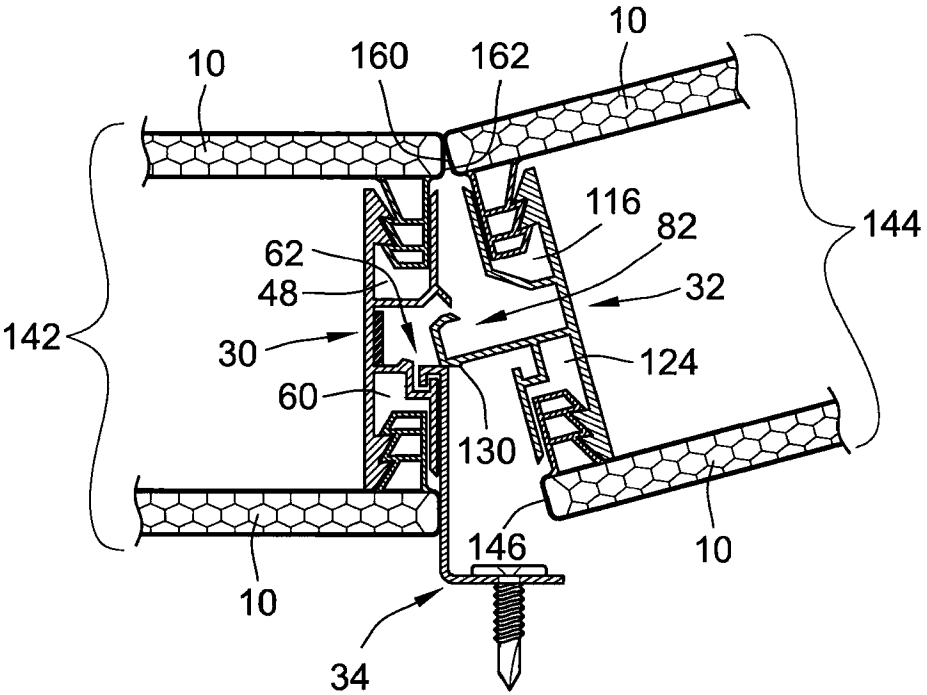

Downwardly directed U-shaped arm 104 of the first locking member includes a generally horizontal portion 120 and a vertical portion 122. Arm 104 and base back surface 106 define a downwardly directed cavity 124 which will engage the upstanding flange of the second modular glazing panel unit 142 (FIG. 4A).

As in the case of first locking member 30, horizontal portion 120 may be stepped downwardly, as shown, to produce a slot 126 having an upwardly directed lip 128 for receiving engagement hook 74 of retention clip 34 to achieve a metal-to-metal engagement. Other alternative structural arrangements for metal-to-metal engagement between the retention clip and the locking member may, of course, be used. Also, as can be readily understood from FIG. 3A, retention clip 34 may be rotated 180 degrees to engage slot 126 and lip 128 of the first locking member rather than step 62 and upwardly directed lip 64 of the second locking member, depending on construction requirements and the desire of the installer erecting the modular glazing panel units in place. Of course, as noted earlier, in less preferred embodiments other locking configurations could be used and, indeed, only one of the first and second locking members may be provided with the slot and lip for accommodating the retention clip. In all cases, the resulting metal-to-metal interconnection or interlocking represents a significant advance over prior systems, providing greatly enhanced resistance to wind load and other advantages as discussed earlier.

Guide member 82 of first locking member 32 includes a spine 83 that projects generally perpendicularly relative to surface 106 of base 90 and in this embodiment extends from portion 120 of downwardly directed U-shaped arm 104. Member 82 has a nub 130 adjacent its distal end 132 which projects downwardly from its bottom surface 134 to cooperate with nub 85 on portion 56 of the second locking member when the first and second locking members are interlocked as will be explained below. Nub 130 has front and back inclined surfaces 136 and 138 which facilitate the interlocking process and help keep the corresponding locking members together as installation of the glazing panel units proceeds.

An end flange 140 is located at the distal end of spine 83 of guide member 82. Flange 140 has a generally flat outer surface 142 and an optional hook portion 145 which is dimensioned to rest below horizontal portion 44 of the second locking member when the first and second locking members are interconnected as in FIG. 3B to help limit water entering the inner gutter from reaching gutter seal 90 and to limit upward movement due to loading on the guide member. Finally, spine 82 and end flange 140 are dimensioned to ensure that when the first and second locking members are interlocked as in FIG. 3B, flat outer surface 141 will abut (and preferably compress) resilient insulating strip 84 in cavity 80 of the second locking member to produce a reliable air, water and sound seal.

Turning now to FIGS. 4A and 4B, locking members 30 and 32 are shown with modular glazing panels 10 locked into respective upwardly and downwardly directed cavities 48, 60, 116, and 124 of the locking members by the engagement between sawteeth 20 of the panel units and sawteeth 50 of the locking members. This forms glazing panel units 142 and 144. Such units may be assembled either on-site in a convenient ground level area or off-site and transported to the work site. Once at the worksite the panel units will be erected into sloped glazing, skylights, roofs, walls or other architectural structures.

The modular panels in glazing panel units 142 and 144 may include optional resilient areas in the form of, e.g., preferably protruding open bubble areas 146 at the lateral edges of the panels. These open bubble areas substantially increase the resilience of the panel edges so that they can deform when the corresponding lateral edges of the panels move in and out due to panel expansion and contraction. The adjacent resilient panel areas cooperate with the first and second engagement members which also accommodate lateral movement. Thus, unlike prior art systems where the lateral panel expansion may cause the modular panels to bow, the panels of glazing panel units 142 and 144 remain flat. At the same time, these resilient edges close the gap between adjacent panels in the panel units to help in limiting or preventing air, water and sound infiltration. Other gap sealing approaches can of course be used.

Referring to FIGS. 4A and 4B, the installation method of the invention may proceed as follows:

A. First, exemplary 40 foot glazing panel units 142 and 144 of FIG. 4A are assembled, transported to the work site if necessary, and then preferably oriented and pre-positioned conveniently to the location where they will be installed. It should be noted that panel unit 142 has a first locking member at its opposite (hidden) lateral edge whereas panel unit 144 has a second locking member at its opposite (hidden) lateral edge.

B. Next, unit 142 may be positioned on the appropriate purlin or rafter (not shown) and locked in place by a series of retention clips 34 spaced, e.g., about 4 to 10 feet apart with their engagement hooks engaging slots 62 and lips 64 of the second locking member which in turn engages and armors or clads the 40 foot modular panel flanges. As noted earlier, attachment to the first locking members may proceed from the other side by rotating the retention clip 180 degrees and first installing panel unit 144 by way of attachment slots 126 and lips 128 of the first locking members. Also, for shorter spans the assembly may not require intermediate support making it possible to dispense with the use of retention clips.

C. Assuming that unit 142 is already affixed in position, modular glazing panel unit assembly 144 is then juxtaposed against unit 142 with its lateral edge 160 opposite the lateral edge 162 of the already affixed panel unit 142. In this orientation, guide member 82 will be located opposite inner cavity 80 of second locking member 30.

D. Then, panel unit 144 will be pivoted about adjoining lateral edges 160 and 162 as inclined surface 136 of nub 130 on the guide member first engages inclined surface 87 on nub 85 of the second member and the nub 130 rides over numb 85 providing the installer with a tactile indication that the first and second locking members are properly interconnected with flat outer surface 141 of flange 140 abutting and preferably compressing resilient insulating strip 84 as depicted in FIG. 3B and the lower lateral panel edges 164 and 166 abutting as well. When the locking members are interconnected in this way abutting inclined surfaces 88 and 138 will maintain glazing units 142 and 144 together so that the installer can move to the next lateral adjacent position to begin installing the next panel unit.

E. In an alternative installation approach, panel unit 144 may be vertically aligned and slid horizontally into place until the locking members are interconnected.

F. This process continues until the outer panel units are reached. The outer panels are affixed by conventional perimeter framing. Thus a series of units held in place by retention clips as illustrated in FIG. 4B and confined by outer panels or separate conventional structural members to ensure that the entire installation will withstand substantial loads even up to hurricane levels while providing outstanding resistance to air, water and sound infiltration as well as outstanding energy conservation characteristics and the ability to accommodate lateral expansion and contraction of the modular panels and glazing panel units to a degree not heretofore thought possible.

Figure 5B:
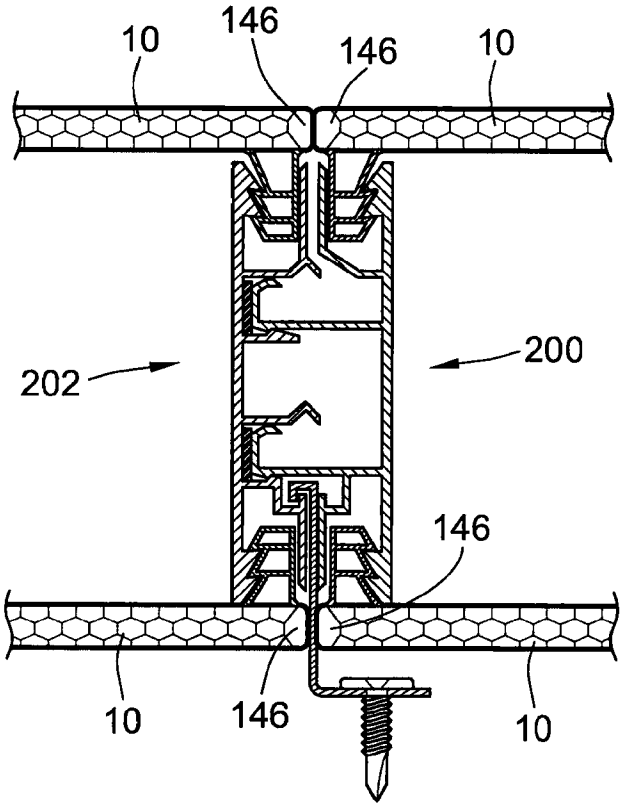
FIGS. 5A and 5B correspond generally to FIGS. 4A and 4B except that alternative first and second locking engagement members are depicted in panel units with an enlarged airspace between the top and bottom panels.
Figure 5A:
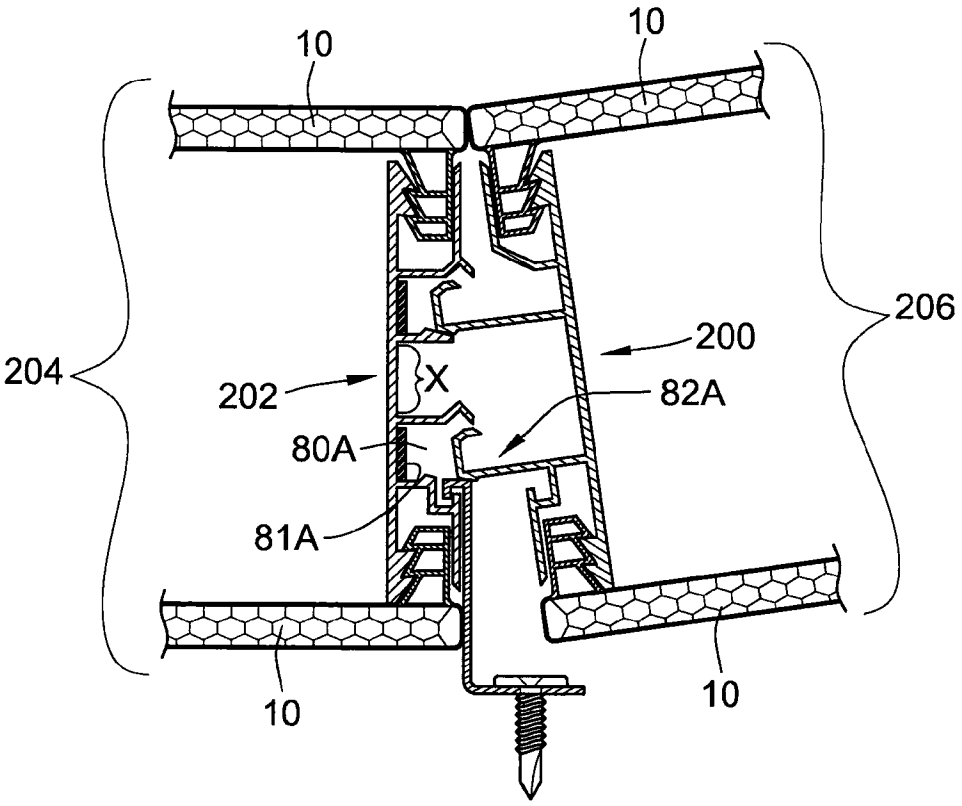

FIGS. 5A and 5B illustrate an alternative embodiment of the invention in which first and second engagement locking members 200 and 202 are used to assemble panel units 204 and 206. As is apparent in these figures, locking members 200 and 202 are taller than locking members 30 and 32 thus establishing a taller and larger airspace between the modular panel pairs of the glazing panel units. For example, the airspace of the units of FIGS. 4A and 4B may be, for example, about 2.5 inches in height whereas the airspace of the units of FIGS. 5A and 5B may be, for example, about 4.0 inches in height. This height difference is achieved by incorporating a second inner cavity 80A and corresponding second guide member 82A spaced a distance "x" from the first inner cavity. Smaller and larger inner cavities and guide members as well as more than two pairs of these features may be used. These additional features further enhance the installation process by, e.g., improving the signaling and interlocking operation of the first and second locking members. The greater height airspace panel units are also stiffer, further enhancing their ability to withstand loads and the added lower inner gutter (which may optionally be fitted with a gasket strip 81A) further limits water, air and sound infiltration.

Figure 6:
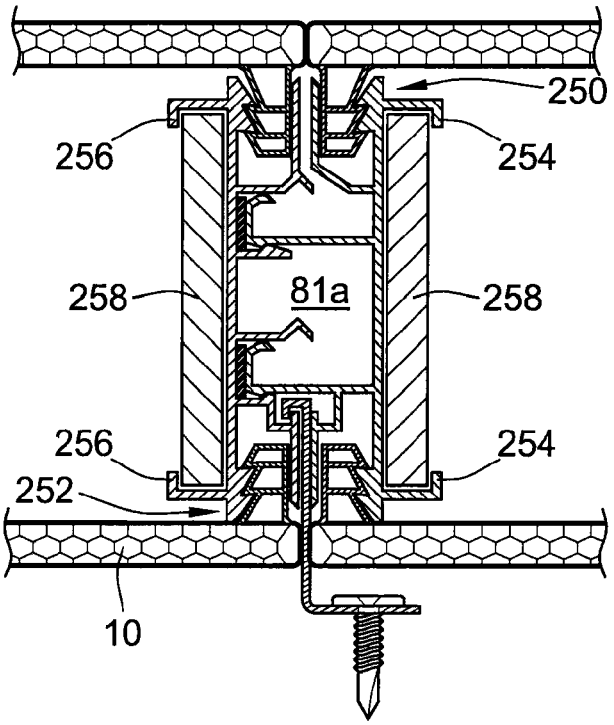
FIG. 6 corresponds to FIG. 5B except that yet another interlocking first and second locking engagement member design is used in which the locking engagement members are provided with side stiffener bars.

FIG. 6 illustrates yet another alternative embodiment of the invention in which first and second locking members 250 and 252 are used. These locking members generally correspond to locking members 200 and 202 of FIGS. 5A and 5B except that the locking members are provided with pairs of outer brackets 254 and 256 for holding side stiffener bars 258. The side stiffener bars run along the locking member improving the section moment of inertia of the locking members, thereby enhancing the load capacity characteristics of the overall panel unit and its ability to handle longer spans. The side stiffener bars are preferably made of solid aluminum or steel although they may be hollow if desired.

Figure 7:
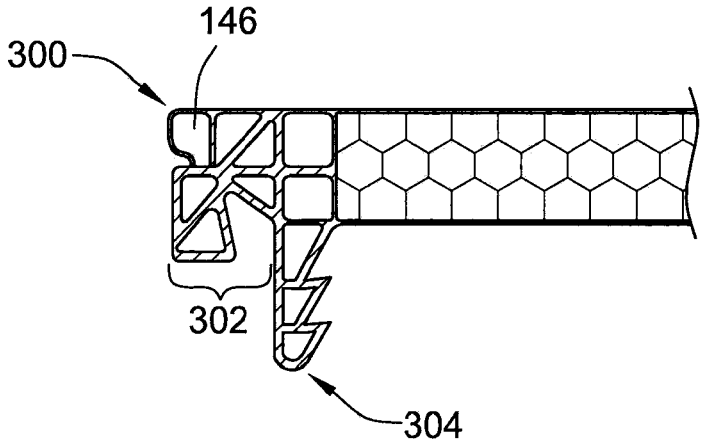
FIG. 7 is a partial exploded perspective view of an alternative modular panel design.
Figure 8A:
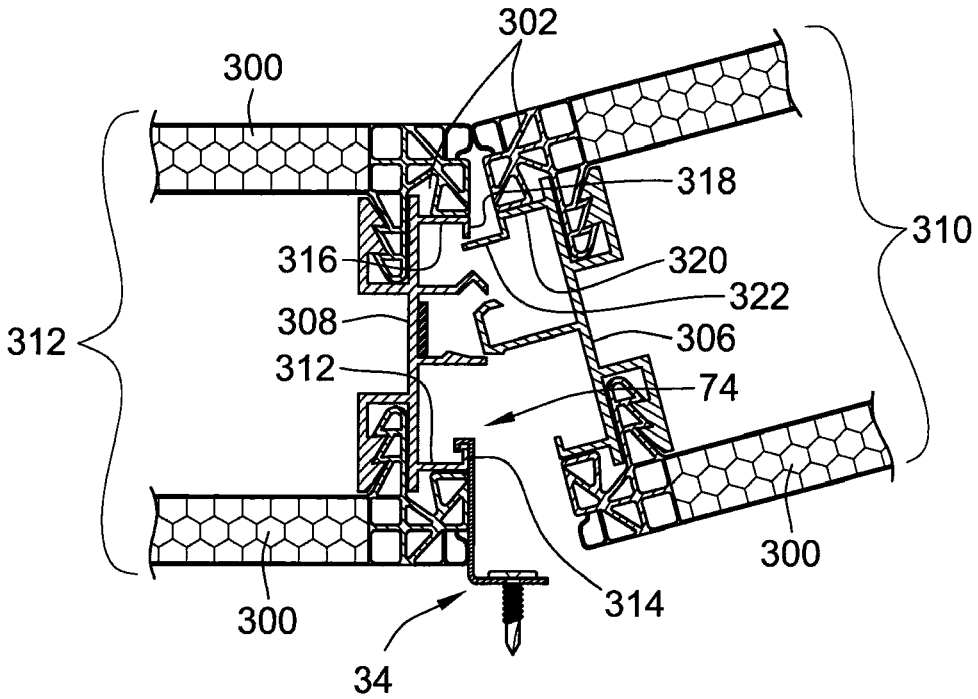
FIGS. 8A and 8B are, respectively, partial elevation views of panel units using still other locking engagement member designs with the modular panels of FIG. 7 in place in the engagement members, before and after interconnection of the engagement members.
Figure 8B:
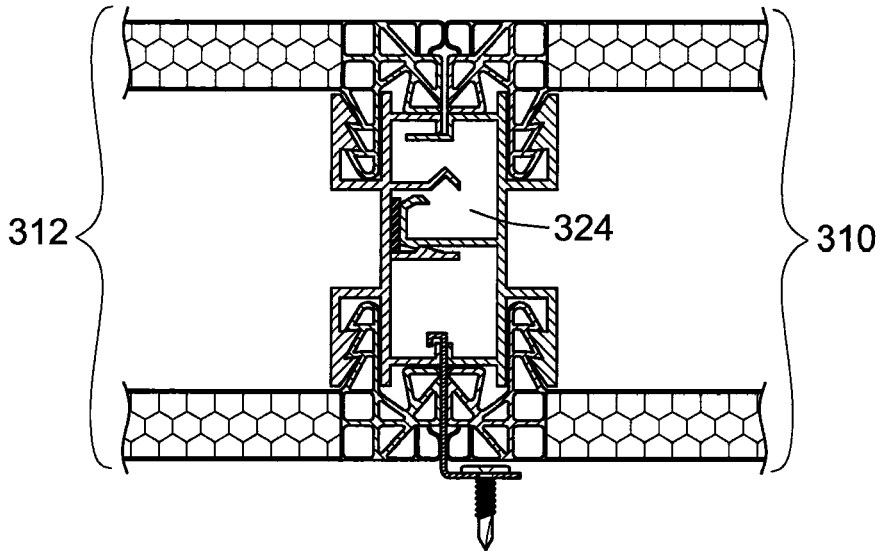

FIG. 7 depicts a modular panel 300 having a double flange design comprising an outer flange 302 and an inner standing seam flange 304. Such panels are shown installed in first and second locking members 306 and 308 in FIGS. 8A and 8B forming panel units 310 and 312. The locking members are interlocked using the pivoting or sliding interlocking motion of the earlier-described locking members and form an inner gutter 324 in the same way using like structural features. Upstanding lip 314 onto which a hook 74 of a retention clip 34 is fit again achieves the metal-to-metal engagement discussed earlier. Additionally, the second locking member includes a ledge 316 (on which outer panel flange 302 rests to provide enhanced load bearing capability) and a downwardly directed shoulder 318. First locking member 306 has a corresponding first shelf 320 for supporting the outer flange 302 of the adjacent panel 300 of panel unit 310. Shelf 320 jogs downwardly to provide a second lower shelf 322 which engages downwardly directed shoulder 318 of the second locking member when the panel units are interconnected as depicted in FIG. 8B. The engagement of shoulder 318 and shelf 322 therefore forms the first line of defense against the infiltration of water into the inner gutter 324 in the interconnected units and also provides enhanced load bearing capabilities (FIG. 8B).

Figure 9:
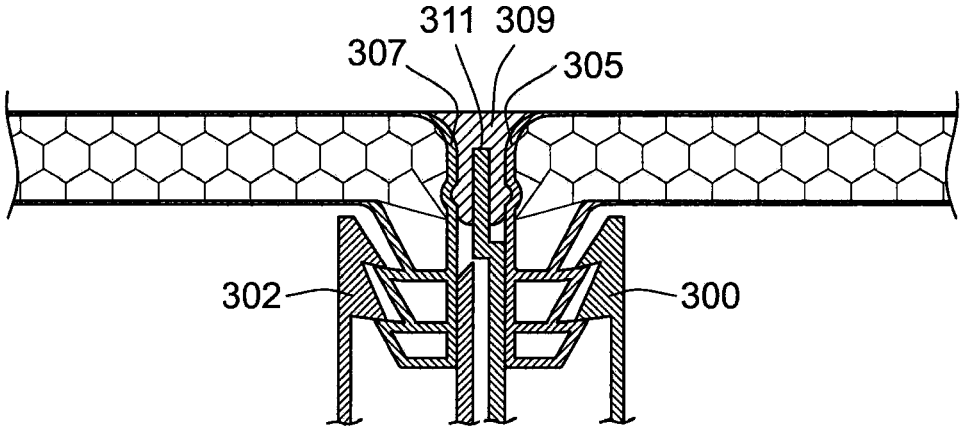
FIG. 9 is a partial elevation view of the tops of adjacent panel units in which a gasket is disposed in the gap between the adjacent top panels and held in place by a pin affixed to one of the locking members of the units.

FIG. 9 is a partial view of the top modular panels of two panel units interconnected using first and second locking members 301 and 303. This Figure is included to illustrate an alternative embodiment in which the lateral edges 305 and 307 of the panels are spaced from each other. In this arrangement, a resilient gasket 309 is fitted into the gap between the panel edges and held in place by a pin 311 affixed to locking member 300.

Figure 10:
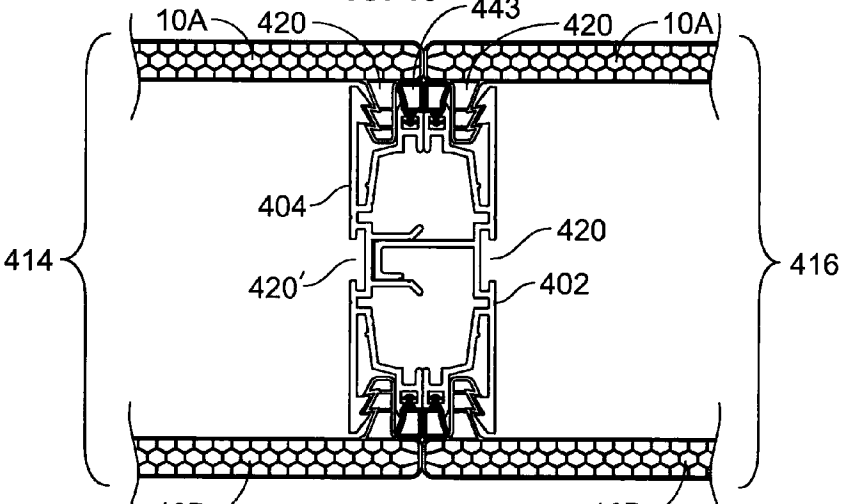
FIG. 10 is partial elevation view of modular glazing panels in which first and second locking members have gaskets to enhance sealing at the interface between adjacent panel ends of the modular panel unit.

FIG. 10 illustrates another embodiment in which pairs of modular glazing panels 10A and 10B are locked into respective upwardly and downwardly directed cavities 406/408 and 410/412 (FIGS. 11A and 11B) of metal first and second locking members 402 and 404. Modular panel units 414 and 416 are formed in this way and then assembled together by interlocking the first and second members as illustrated in FIG. 10.

Figure 11A:
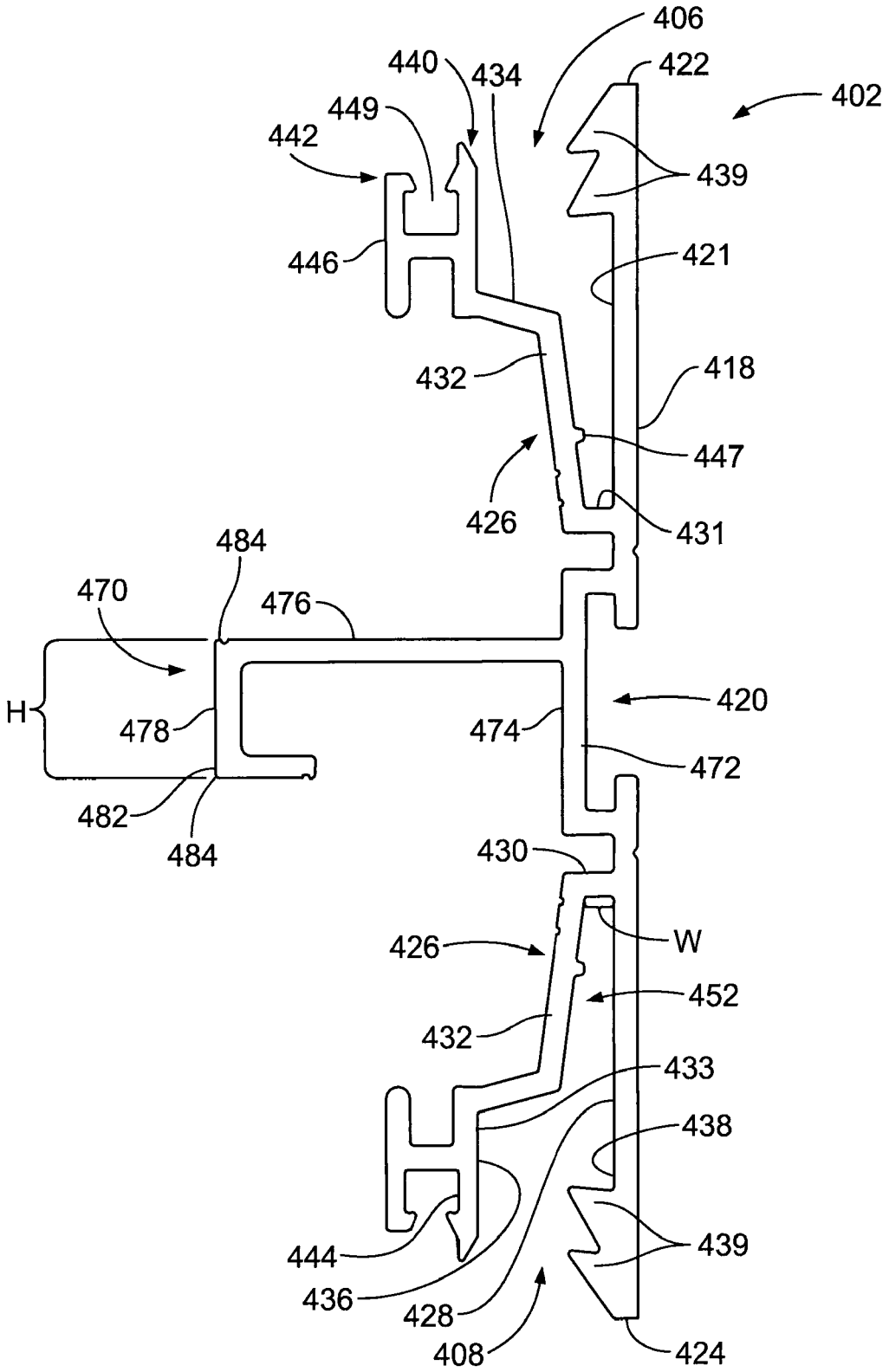
FIGS. 11A and 11B are elevation views taken respectively at the ends of yet another embodiment of first and second locking engagement members.

Turning now to FIG. 11A, first locking member 402 of FIG. 10 has a back wall 418 interrupted at its midpoint by a slot 420 which extends along the first locking member and is positioned to open into the area between the paired modular panels of a glazing panel unit as can be seen in FIG. 10. Fireproofing, aluminum members, sound proofing or insulation provided with tabs as appropriate may be fixed in the area between the panel pairs by attaching the tabs to this slot as desired. Back wall 418 extends between the top edge 422 and the bottom edge 424 of the first locking member.

A cantilever arm 426 extends from the inner surface 421 of back wall 418. Cantilever arm 426 include a base portion 430 that is generally perpendicular to the inner surface of the back wall and has a predetermined width "W." An angled member 432 extends from base 430 and the cavity bottom member 434 extends laterally from upwardly angled member 432. Finally, a cavity sidewall member 436 extends generally parallel to back wall inner surface 421 to form one side of cavities 406/408. The opposite side of the cavities comprises a portion of inner surface 421 and a pair of sawteeth 439 at the top and bottom of the locking member which project into cavities 406 and 408.

As can be seen in FIG. 10, sawteeth 20 of glazing panel 10A or 10B will fit within cavity 406 or 408 with the panel sawteeth engaging sawteeth 439. Additionally, in order to facilitate the assembly of the panel sawteeth into the cavity, a bevel 440 may be formed on the inner surface of sidewall member 436 to help guide the panel sawteeth into place in the cavity.

A "T" shaped member 442 projects from the outer surface 444 of sidewall member 436. The T-shaped member presents an outer abutment surface 446 to help ensure proper parallel alignment of the modular panel units when then they are interconnected by way of first and second locking members.

First locking member 402 also includes slots 449 running behind abutment surface 446 of T-shaped member 442. These slots may receive a locking portion 445 of an elongated gasket 443 (FIG. 10). When these gaskets are positioned as illustrated in FIG. 10, they achieve an enhanced sealing at the interface between adjacent panel ends of each modular panel unit.

The respective inner surfaces 421, 431 and 433 of back wall 418, cantilever arm base 430 and cantilever sidewall member 436 define a cavity 452 for receiving the upper retention portion 464 of a unique clip member 454 which is described immediately below and illustrated in FIGS. 12A-12C and 14. Inner surface 433 of the cantilever sidewall member also includes a boss 447 that helps insure that the upper retention portion of clip member 454 is firmly retained in cavity 452 and maintained in abutment against inner surface 428.

First locking member 402 also includes a guide member 470 that is disposed generally perpendicularly with respect to back wall 418 and projects from the inner surface 474 of slot wall 472. The guide member includes a spine 476 and a generally rectangular flange 478 at its distal end. Flange 478 includes an abutment surface 482 that is generally parallel to back wall 418 and is of a height "H" corresponding to the height of a receiving cavity 490 of second locking member 404 (FIG. 11B) to insure that the flange fits properly in the receiving cavity of second locking member 404, as will be discussed below. Finally, it is noted that flange 478 includes outer corners 484.

Figure 11B:
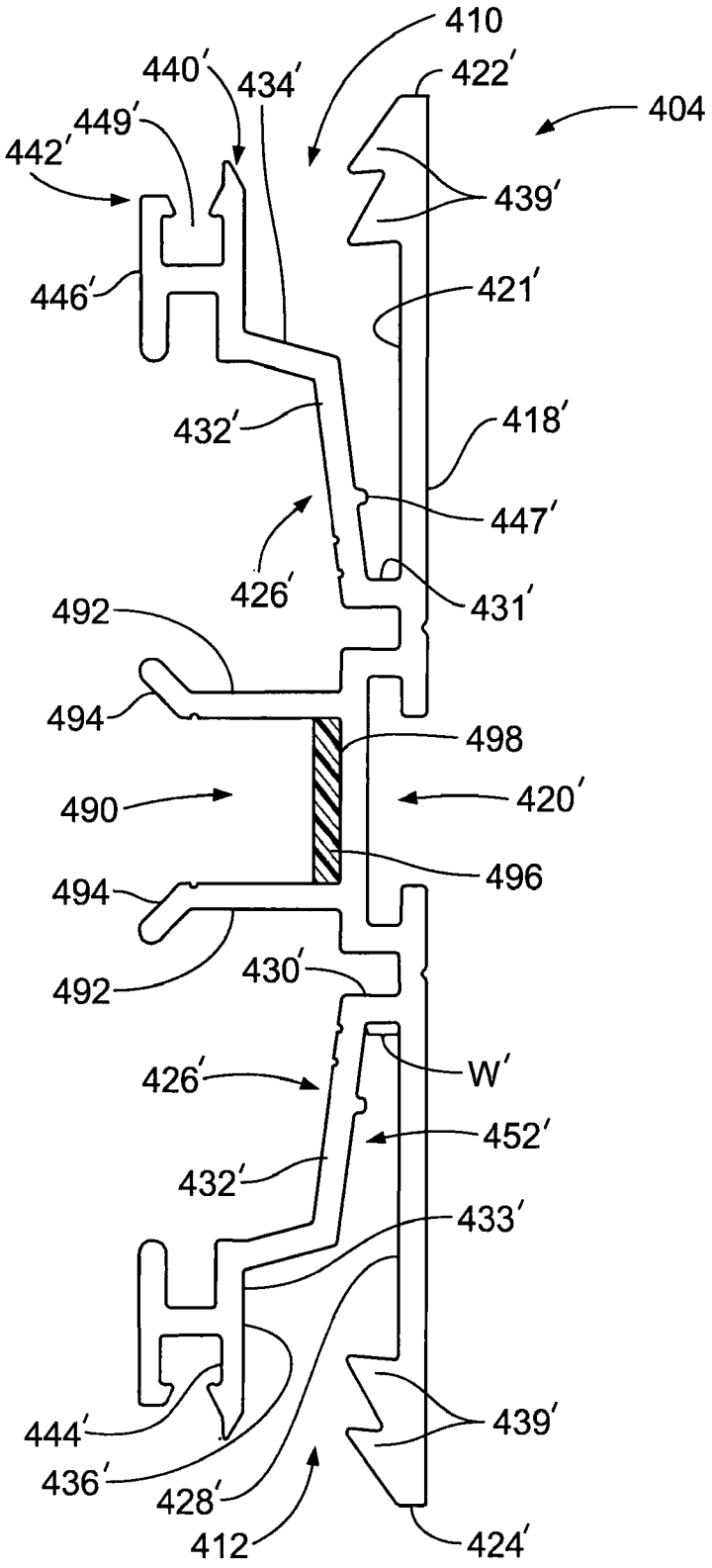

FIG. 11B illustrates second locking member 404. As described above with respect to the first locking member, this locking member includes a back wall 418' interrupted at its midpoint by a slot 420' which extends along the first member and is positioned to open into the area between the paired panels of a modular panel unit. Fireproofing or insulation may be fixed in the area between the panel pairs by way of a tab attached to this slot, as desired, as discussed earlier with respect to locking member 402. Back wall 418' extends between the top 422' and the bottom 424' of the first locking member.

Cantilever arms 426' extend from the inner surface 421' of back wall 418'. Cantilever arms 426' include a base portion 430 that is generally perpendicular to the inner surface of the back wall and has a predetermined width "W'." An angled member 432' extends from base 430' and the cavity bottom member 434' extends laterally from upwardly angled member 432'. Finally, a cavity sidewall member 436' extends generally parallel to back wall inner surface 421' to form one side of cavities 410 and 412. The opposite side of the cavities comprises a portion of inner surface 421 and a pair of sawteeth 438 at the top and bottom of the locking member which project into cavities 410 and 412.

As can be seen in FIG. 10, sawteeth 20 of glazing panel 10A or 10B will fit within cavity 410 or 412 with the panel sawteeth engaging sawteeth 439. Additionally, in order to facilitate the assembly of the panel sawteeth into the cavity, a bevel 440' may be formed on the inner surface of sidewall member 436' to help guide the panel sawteeth into place in the cavity.

A "T" shaped member 442' projects from the outer surface 444' of sidewall member 436'. The T-shaped member presents an outer abutment surface 446' to help ensure proper parallel alignment of the panel units when they are interconnected by way of the first and second members.

Second locking member 404 also includes slots 449' running behind abutment surface 446' of T-shaped member 442'. These slots may receive a locking portion 445 of an elongated gasket 443 (FIG. 10). When these gaskets are positioned as illustrated in FIG. 10, they achieve an enhanced sealing at the interface between adjacent panel ends of each modular panel unit.

The respective inner surfaces 421', 431' and 433' of back wall 418', cantilever arm base 430' and cantilever sidewall member 436' define a cavity 452' for receiving the upper retention portion 464 of a unique clip member 454 which is described immediately below and illustrated in 12A-12C and 14. Inner surface 433' of the cantilever sidewall member also includes a boss 447' that helps insure that the upper retention portion of clip member 454 is firmly retained in cavity 542 and maintained in abutment against inner surface 428'.

Second locking member 404 has a flange-receiving cavity 490 positioned along the midline of the locking member which opens away from back wall 418'. Flange receiving cavity 490 is defined by side members 492 which are oriented generally perpendicularly with respect to back wall 418'. Outwardly angled lips 494 are formed at the distal edges of the side members. These lips will engage outer corners 484 of flange 478 of the first locking member to help guide the flange into the flange-receiving cavity when panel units are moved into interlocking position.

In some embodiments, a resilient sealing strip 496 will be applied to the bottom surface 498 of the flange-receiving cavity. Alternatively, such a resilient strip may be applied to abutment surface 482 of flange 478 of first engagement member 402, or resilient strips may be applied to both the abutment surface of the flange and the inner surface of the cavity bottom. When one or more such resilient strips are used and the locking members are interconnected with the abutment surface 482 of the flange adjacent the bottom surface 498 of the flange-receiving cavity, the resilient insulating strip(s) will be compressed to achieve improved soundproofing and air/water sealing.

Figure 12B:
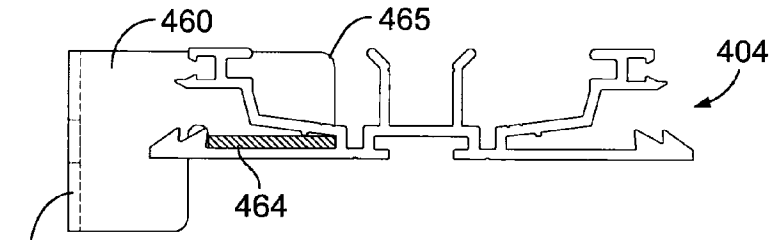
FIGS. 12B and 12C are partial elevation views showing the clip of FIG. 12A affixed to the engagement members of FIGS. 11A and 11B.
Figure 12A:
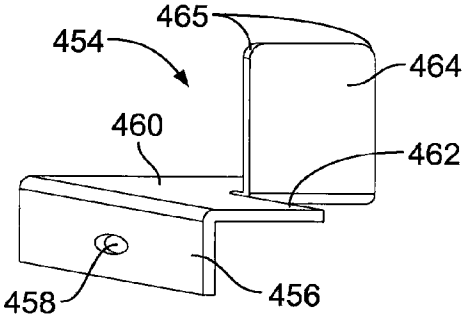
FIG. 12A is a perspective view of a clip member intended to be used with the locking engagement members of FIGS. 11A and 11B.
Figure 12C:
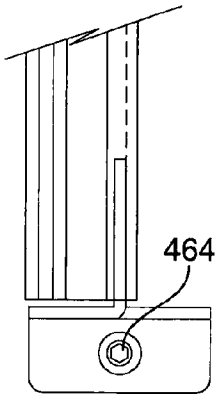

Clip member 454 is depicted in FIGS. 12A-12C. As can be seen in these figures, the clip member includes a base 456 having an opening 458 for receiving a fastener. A sidewall 460 extends generally perpendicularly from base 456. Sidewall 460 is slit along 462 so that the upper retention portion 464 of the sidewall can be bent substantially perpendicularly to project in the opposite direction from base 456. Upper retention portion 464, which may be radiused at corners 465 to facilitate insertion into cavity 452, is dimensioned to fit snuggly in cavity 452 for locking edge glazing panel units in place from their opposite ends, as will be described below. This is made possible by the enhanced strength/moment of inertia achieved by the armoring or cladding of the flanges of the glazing panels by the clip receiving locking members.

Figure 15:
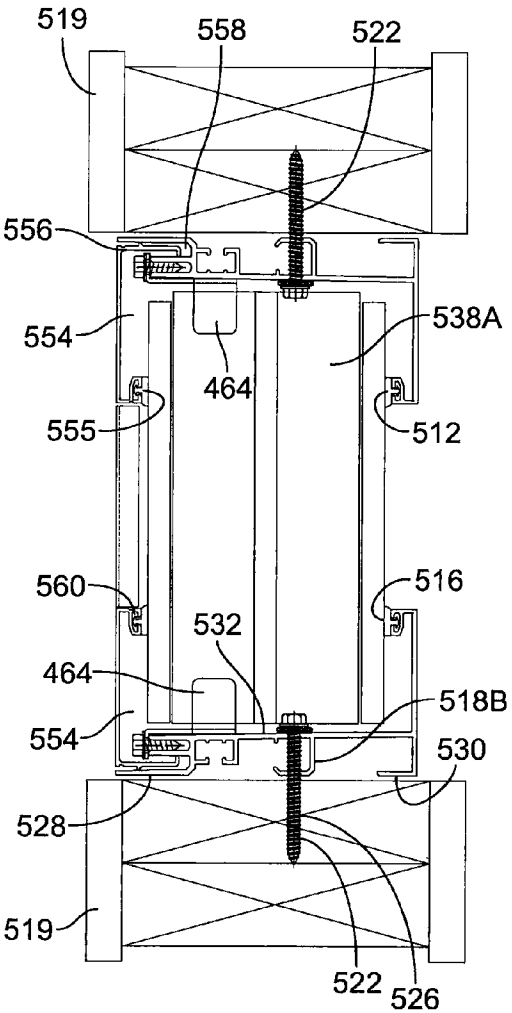
FIG. 15 is a side elevation view illustrating the attachment of the sill frame of FIG. 14 to a structural support member of the frame of FIG. 13.
Figure 13:
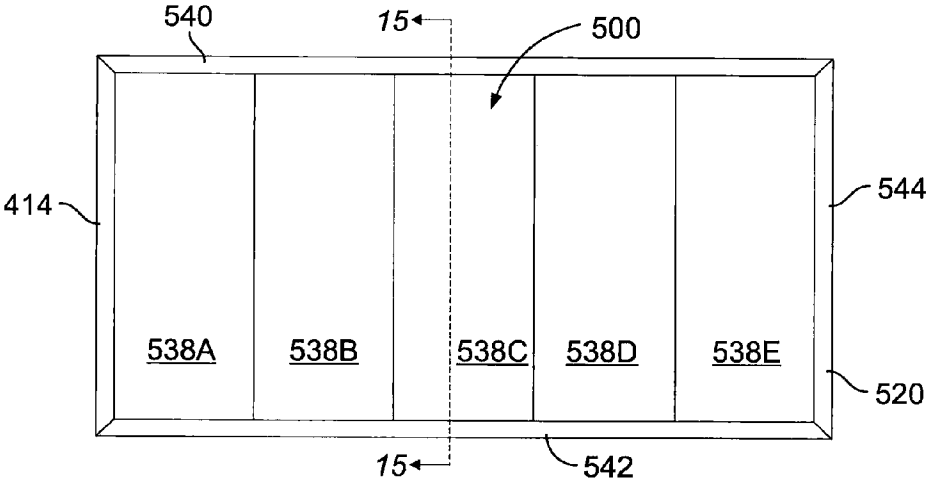
FIG. 13 is a partial elevation view of a vertical opening with a support frame into which glazing panel units are installed.
Figure 14:
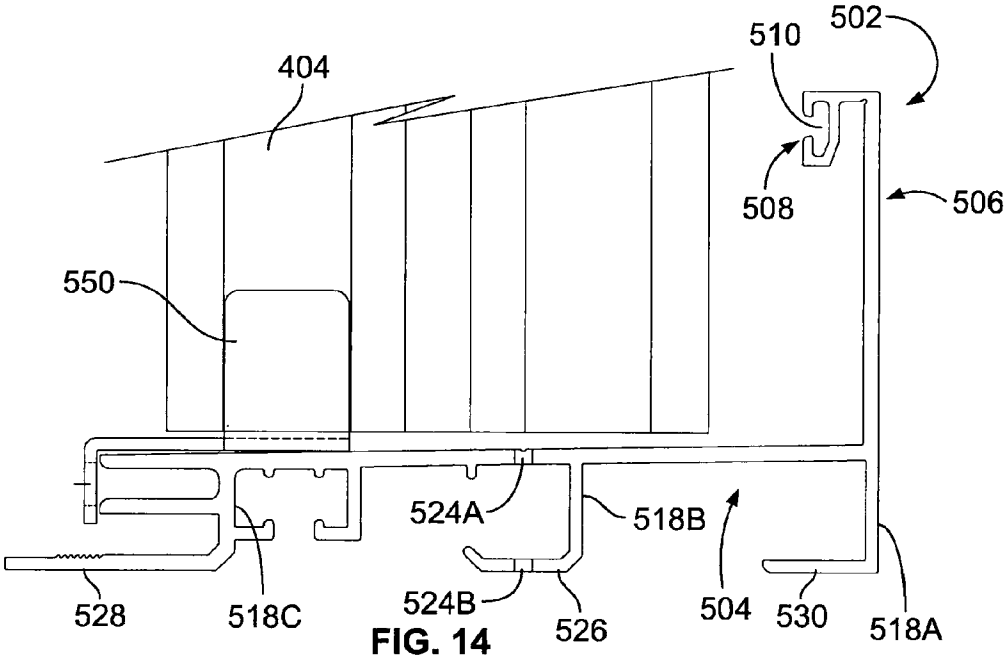
FIG. 14 is an elevation view of a sill frame which may be used in the support frame of FIG. 13.

FIG. 13 illustrates a vertical opening 500 into which glazing panel units may be installed. In one installation approach, sill frames 502, as illustrated in FIG. 14, 538A-538B may be used. Sill frames 502 may be generally "L" shaped, as shown, and include a base portion 504 and an upstanding portion 506 that includes gasket holding means 508 at its distal end (FIG. 15). The gasket holding means include a cavity 510 FIG. 510 for receiving the base 514 of a resilient gasket 512. As can be seen in FIG. 15, gasket 512 presents a generally flat surface 516 generally parallel to the upstanding portion 506. Base portion 504 of the seal frame includes a series of spacer legs 518A, 518B and 518C which are designed to rest against a structural support member to which the sill frame is attached.

Attachment of the sill frame to support frame in 520 (FIG. 13) may be achieved by passing a screw fastener 522 through pairs of bores 524A and 524B, spaced respectively along base 504 of the support frame and foot 526 of spacer leg 518B and driven into support framing 519. When the series of screws along the sill frame member are driven home, feet 526, 528 and 530 of spacer legs 518A, 518B and 518C will rest firmly against the top surface 532 of the support framing.

Returning to FIG. 13 and opening 500, is noted that this opening is framed out with a header 540 at its top, a sill 542 at its bottom and side framing members 544 and 546.

Installation of a series of glazing panel units 538A-538E may be accomplished as follows.

1. First, sill frames 502 are affixed to the header and sill using a series of screw fasteners 522, as described above.

2. Then, glazing panel unit 538A is slid into place against side member 546 with the back surface of the panel unit abutting gaskets 512 on upstanding portion 506. This first panel unit is locked in place by positioning upper retention clip portion 464 in the clip receiving cavity 452 of one of first and second locking members of the panel unit. Once panel unit 538A is properly positioned with the clips in place, a fastener may be passed through hole 458 in the base 456 of the clip to fasten panel 538A in place.

3. An L-shaped cover element 554 may then be employed as shown in FIG. 15 to cover the sill frame and the interface between the modular panel unit, the sill frame and the support member for aesthetic purposes. L-shaped cover 554 includes a base 556 which is press fit into a receiving cavity 558 in the sill frame. A gasket receiving member 560 preferably is provided at the distal end of base 554 of the L-shaped cover and a gasket 555 disposed therein to provide a seal against the surface of the front panel of the modular panel unit.

4. Once glazing panel unit 538A is fixed in place, successive panel units 538B, 538C, 538E and 538F are installed by aligning and moving the flange of one of the first and second locking members of each panel unit into the corresponding flange receiving cavity of the other one of the first and second locking members so that the panels are in position with the abutment surfaces of T-shaped members 442 against each other. In the course of assembling the glazing panel units into place in this fashion, clip members 454 will be provided at opposite ends of each modular panel unit and then screwed into a support member to lock the panel units in place.

If it is subsequently necessary to remove any particular panel unit, it will only be necessary to disconnect its clip members and remove it from opening 500.

Since the first and second locking members greatly enhance the structural characteristics of the panels and hence the modular panel units, substantially enhanced spans may be covered in this fashion in vertical, horizontal and angled applications. However, when the span exceeds the structural specifications of these metal cladded units, intermediate structural supports may be provided with clips affixed to the first and second locking members and the intermediate structural elements.

The following figures illustrate additional embodiments.

Figure 16:
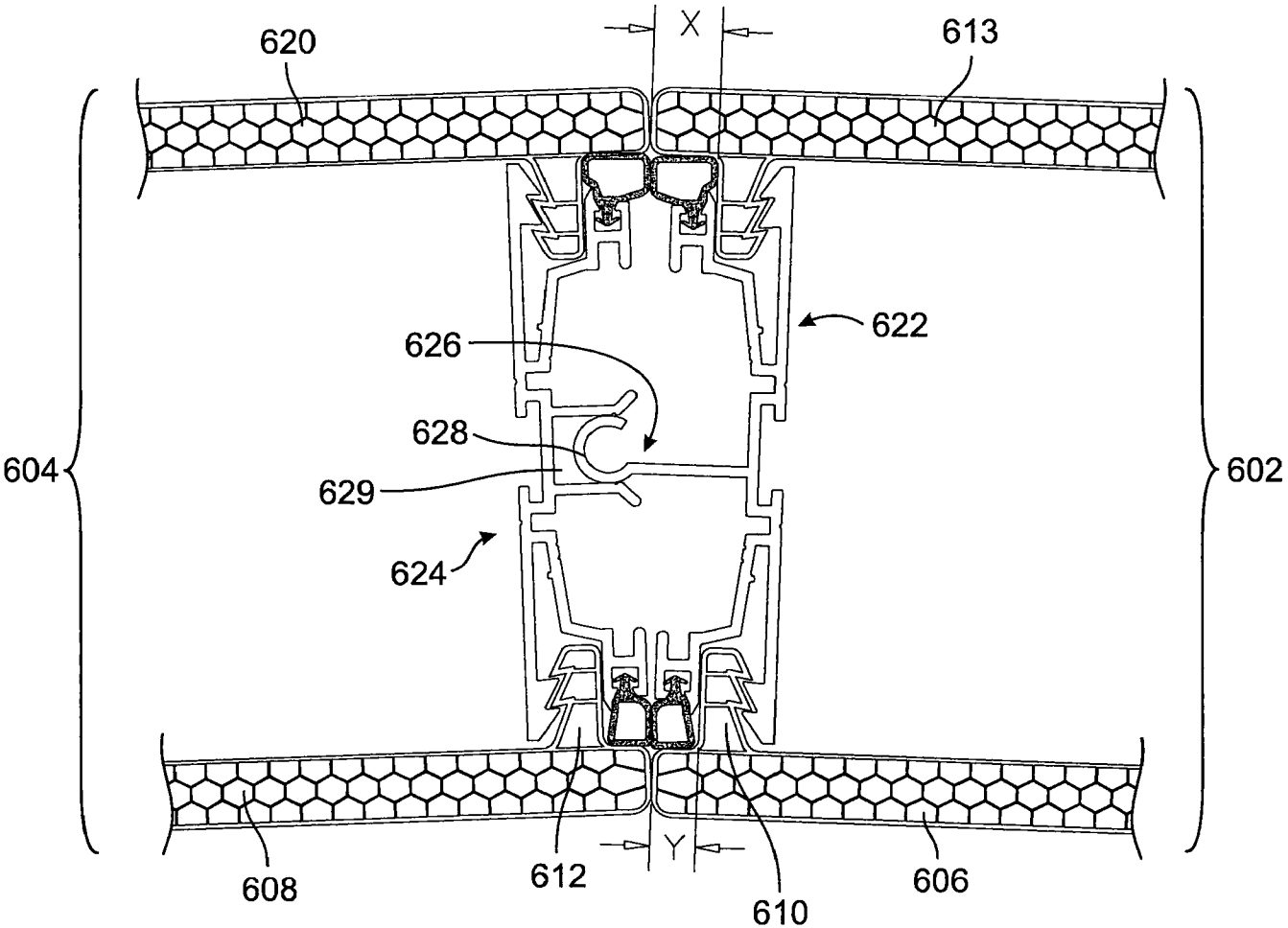
FIG. 16 is a partial elevation view of adjacent modular panel units affixed in a curved or radiused configuration.

FIG. 16 illustrates an embodiment in which modular panel units 602 and 604 having lower panels 606 and 608 with their flanges 610 and 612 spaced a distance "Y" from the edges of the panels and their upper panels 618 and 620 spaced a larger distance "X" from the edge of the panels to achieve a radiused configuration or circularly disposed assembly of glazing panel units. The locking members in this embodiment correspond generally to locking members 402 and 404 of FIGS. 11A and 11B except that guide member 626 of locking member 622 has a circular leading edge 628 which accommodates the radius configuration since it is able to rest within cavity 629 of locking member 624.

Figure 17:
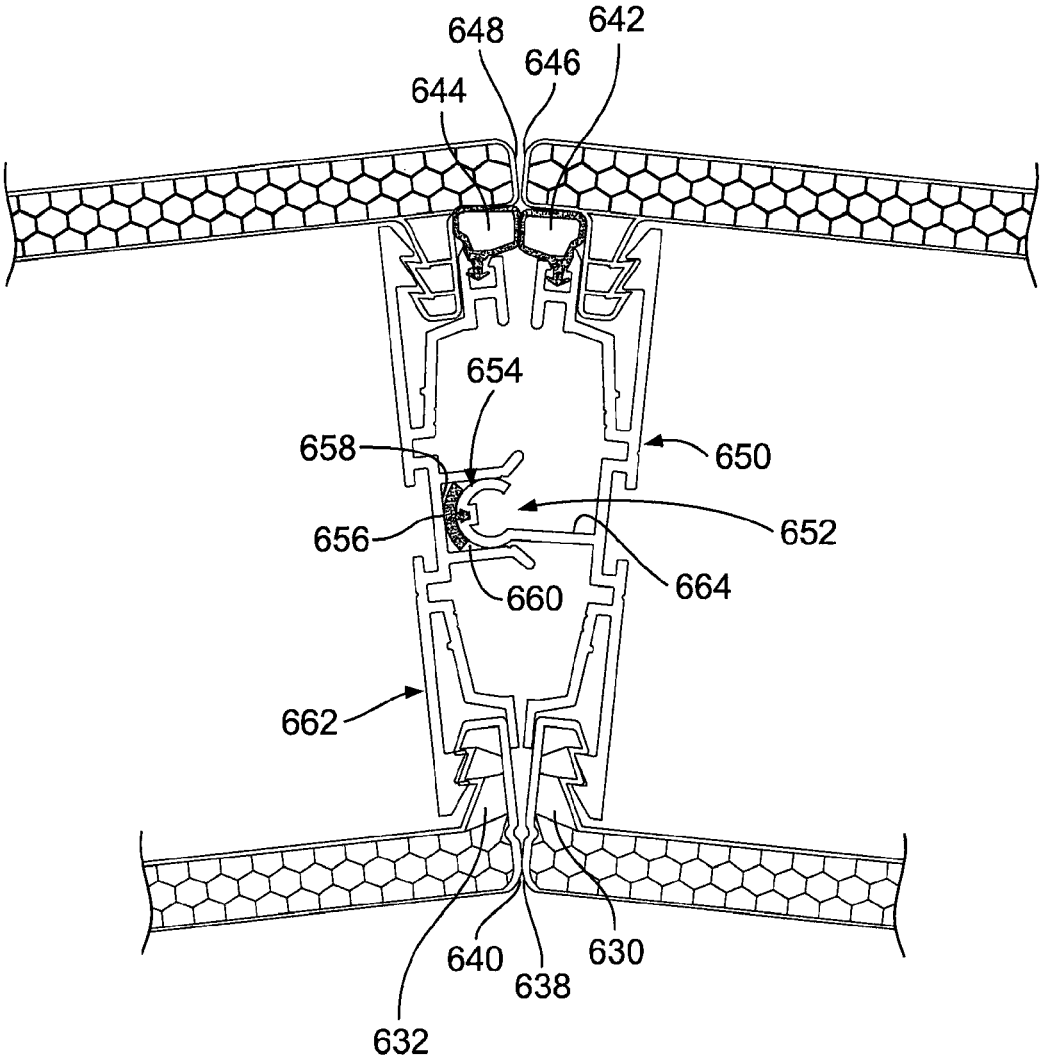
FIG. 17 is another partial elevation view of adjacent modular panel units affixed in a radiused or curved configuration.

FIG. 17 is another embodiment in which a radiused configuration is achieved. In this embodiment, the upstanding flanges 630 and 632 of lower panels are located at the lateral edges 638 and 640 of these panels and the flanges 642 and 644 of the upper panels are spaced from the lateral edges 646 and 648 of the upper panels. Also, in this embodiment, the first locking member 650 includes a flange 652 with a round distal end 654 which facilitates the angled (nonperpendicular) disposition of the first and second interlocking members. A gasket 656 may optionally be fitted to the outer edge of the curved flange of the guide member to seal against the bottom surface 658 of the flange receiving cavity 660 of the second locking member 662 as shown. Additionally, in this embodiment, the spine 664 of the guide member is designed to be of a length that ensures that the outer surface of the guide member sits properly in the flange receiving cavity.

Figure 18:
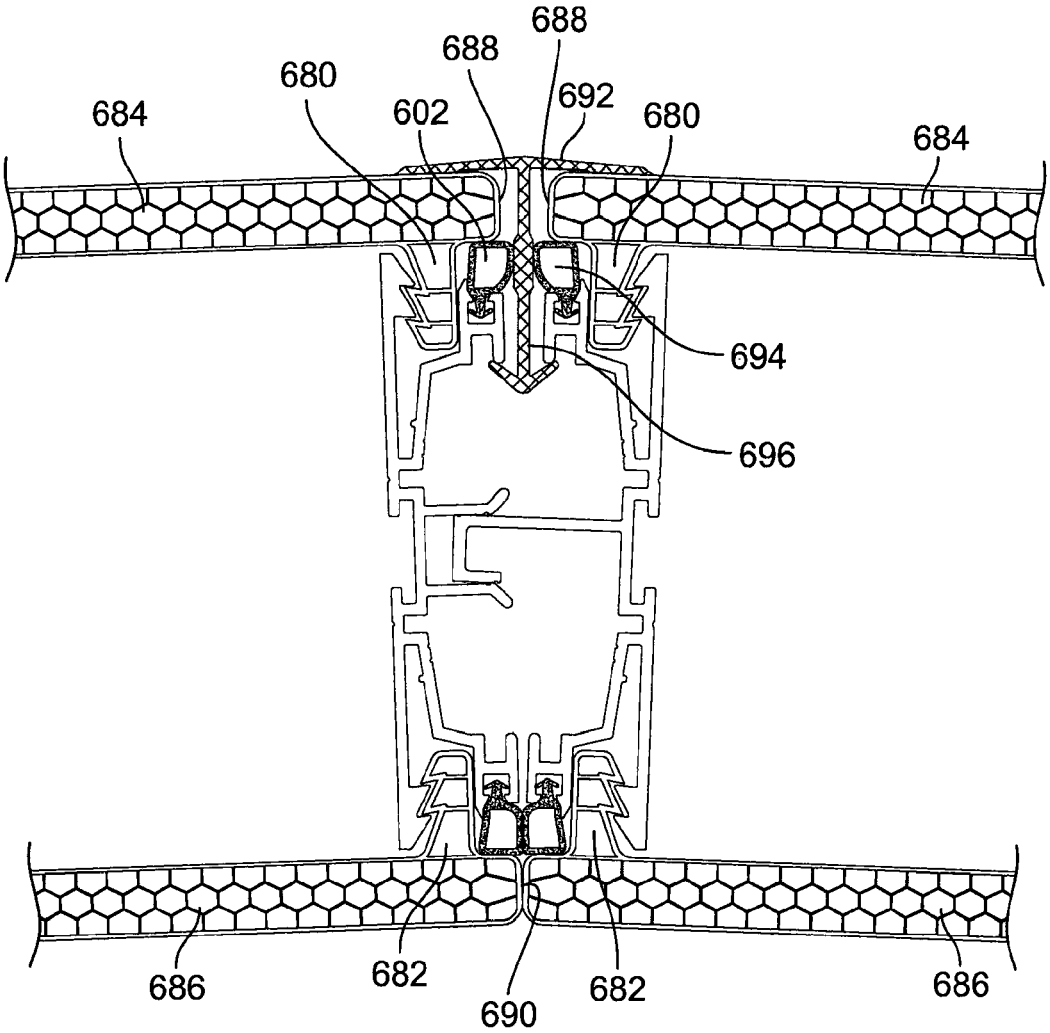
FIG. 18 is a partial elevation view of adjacent modular panel units in which a radiused configuration is achieved by inserting a spacer member between the top panels of the adjacent panel units.

In FIG. 18 the sawteeth flanges 680 and 682 of the top and bottom panels 684 and 686 of the modular panel units are again spaced from the lateral edges 688 and 690 of the panels. However, a radiused configuration is achieved in this embodiment by inserting a spacer member 692 between the top panels of the adjacent panel units. Gaskets 694 of the first and second locking members abut a center strip 696 of the spacer member to achieve a sound and water/air seal.

Figure 19:
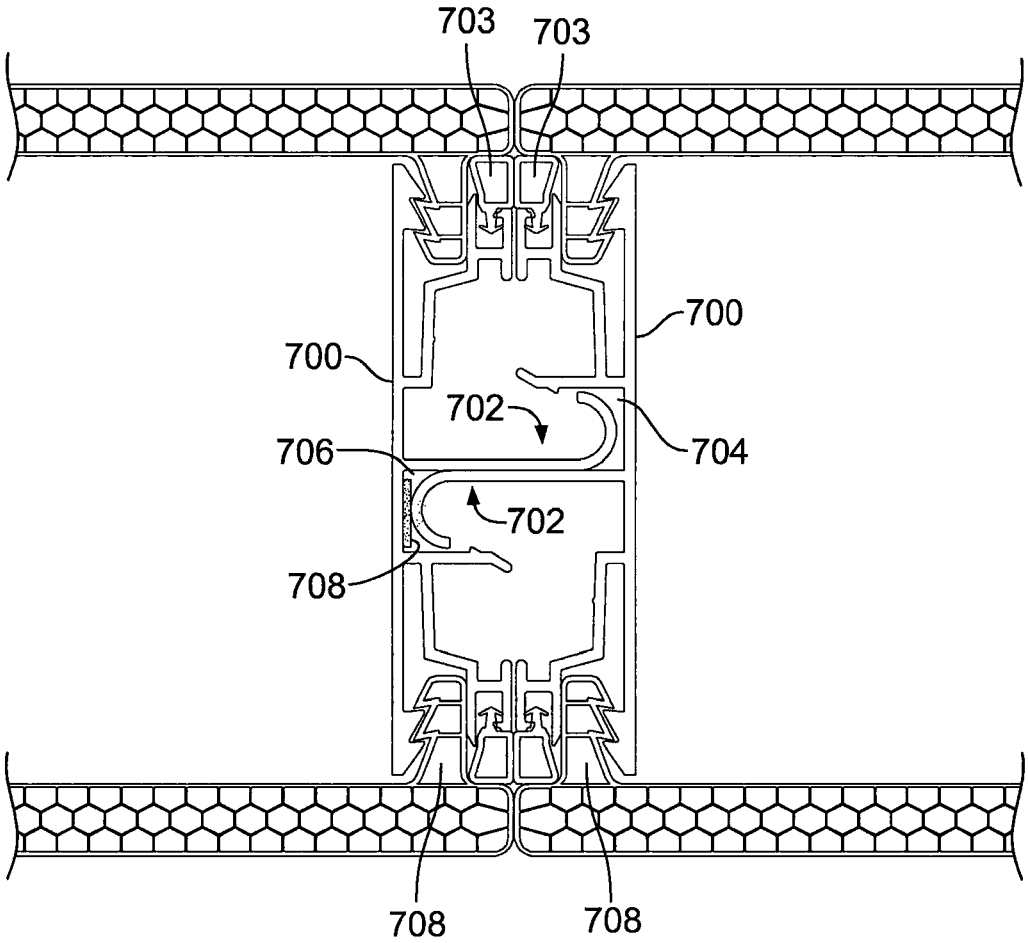
FIG. 19 is a partial elevation view of modular panel units mounted in interlocked hermaphroditic locking members.

FIG. 19 illustrates hermaphroditic locking members 700 which may be used to interchangeably because each includes like guide members 702 and flange receiving cavities 704/706. As can be seen in this figure, receiving cavity 706 includes a gasket 708 which engages the distal end of one of the guide members to produce a seal when the locking members are interlocked. This figure also includes gaskets 708 which are fit into the hermaphroditic locking members like, for example, gaskets 443 in FIG. 10 to produce a seal as described above.

Figure 20A:
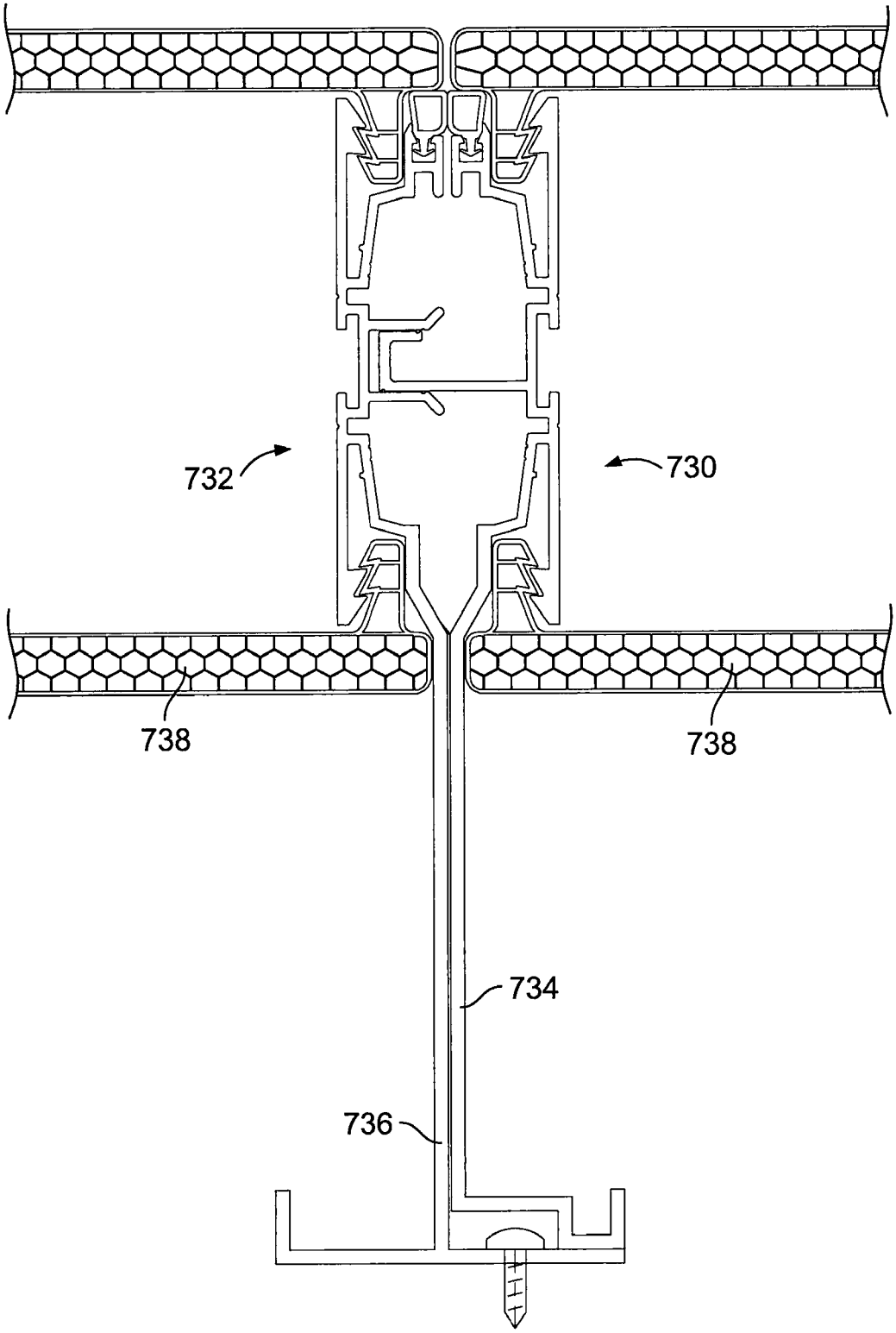
FIGS. 20A and 20B are partial elevation views of interlocked modular panel units where the locking members holding the panel units include rigid elongated members or extensions which improve the rigidity and moment of inertia of the panel units.
Figure 20B:
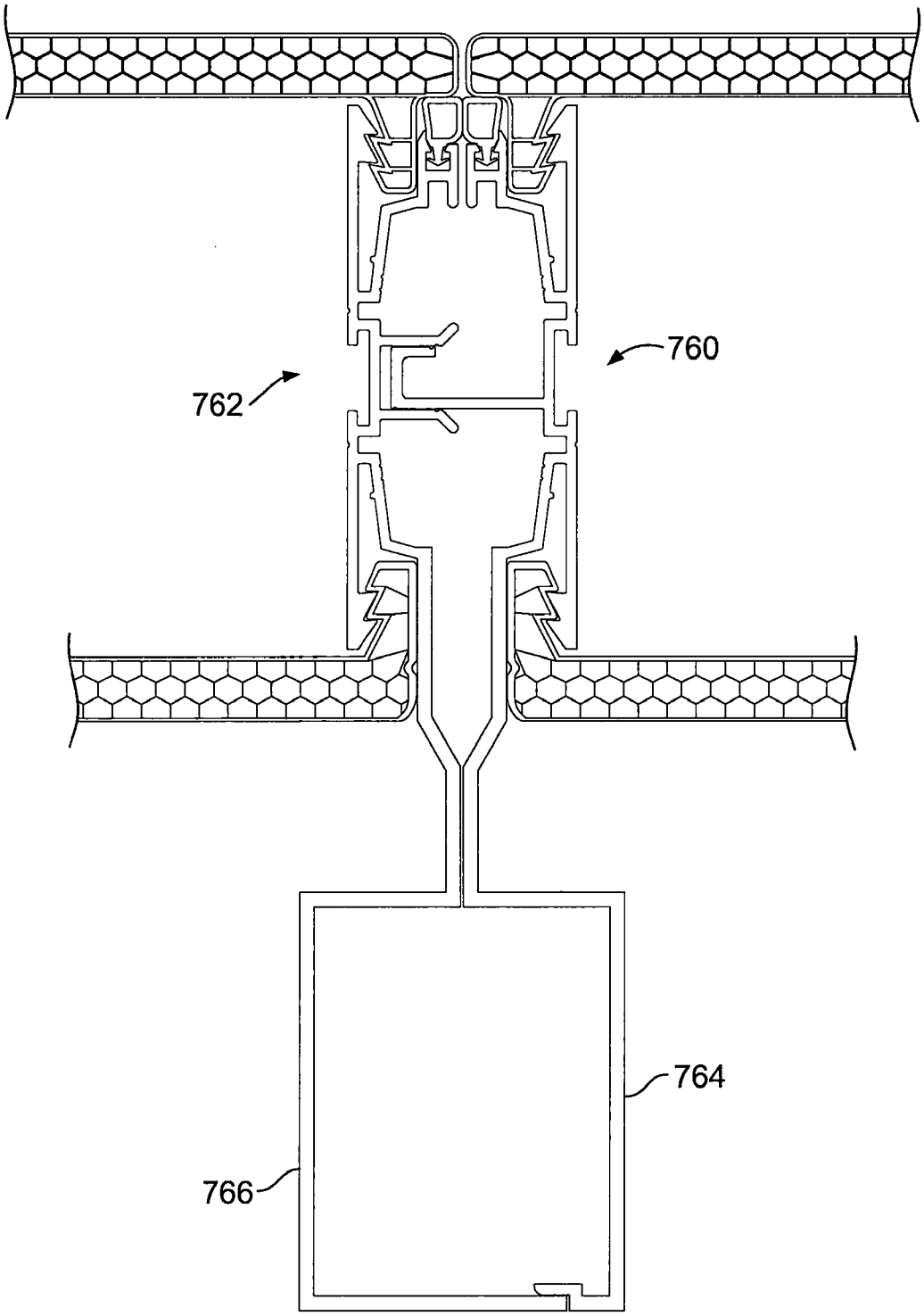

FIGS. 20A-20B illustrate embodiments in which first and second locking members 730/732 and 760/762 include rigid elongated members or extensions 734/736 and 764/766 which are designed to extend below the lower panels 738 and 768 of the modular panel units (or when single panels are used, below the single panels) to improve the rigidity/moment of inertia of the panel units (or panels), so that they can extend over greater spans without intermediate supports.

Figure 21:
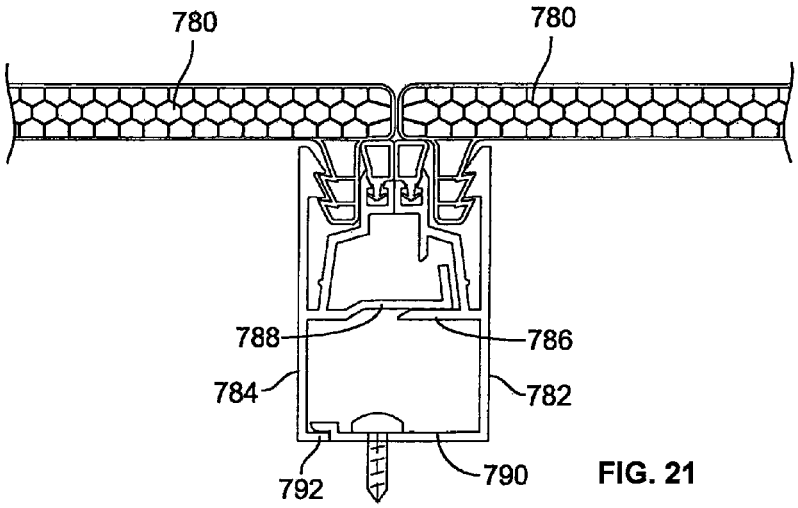
FIG. 21 is a partial side elevation view of single modular panels mounted in interlocking members having interlocking strengthening extensions.

FIG. 21 illustrates an embodiment in which single panels 780 are interconnected by first and second locking members 782 and 784 in accordance with an embodiment of the invention in which interlocking strengthening extensions 786/788 and 790/792 are provided. In this embodiment, strengthening extension 790 is fixed onto a purlin or other support member by passing a fastener through a bore in the strengthening extension, as shown in this figure. Most importantly, downward movement of the panels due to, e.g., positive pressure of a snow load is resisted by strengthening extension 786 which supports and prevents downward movement of strengthening extension 788. On the other hand, upward movement of the panels due to, e.g., wind load is resisted by strengthening extension 790 which abuts strengthening extension 792 and prevents it from moving upwardly.

Figure 22B:
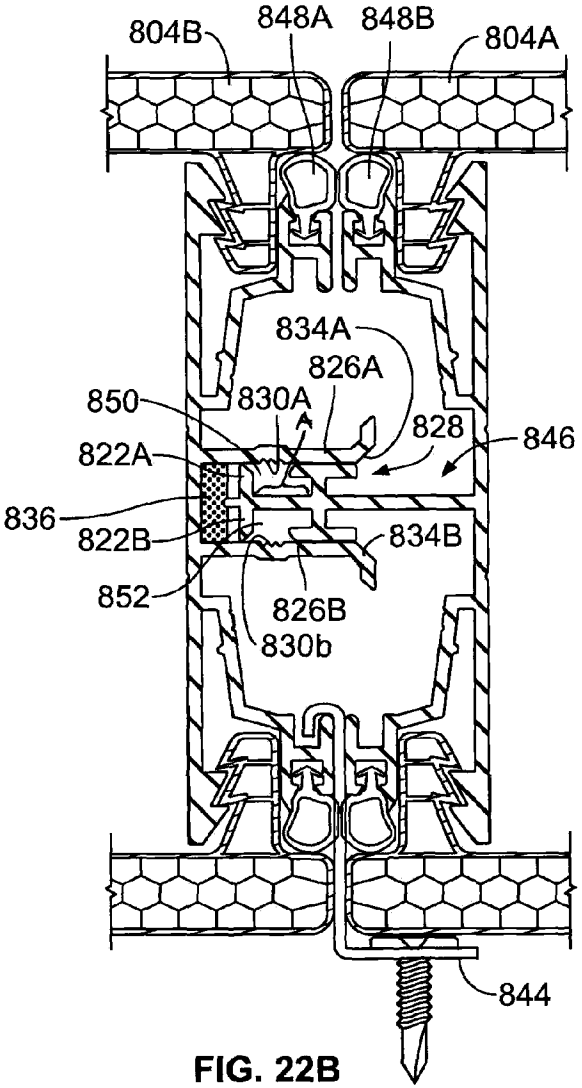
FIGS. 22A-22C are side elevation views of modular panel units in which the first locking members includes a male member with catch rails designed to engage one of the opposing walls of the female member of the corresponding locking member as necessary to prevent disengagement (FIG. 22B) between the locking members when excessive wind or snow loads are applied to the panel units.
Figure 22A:
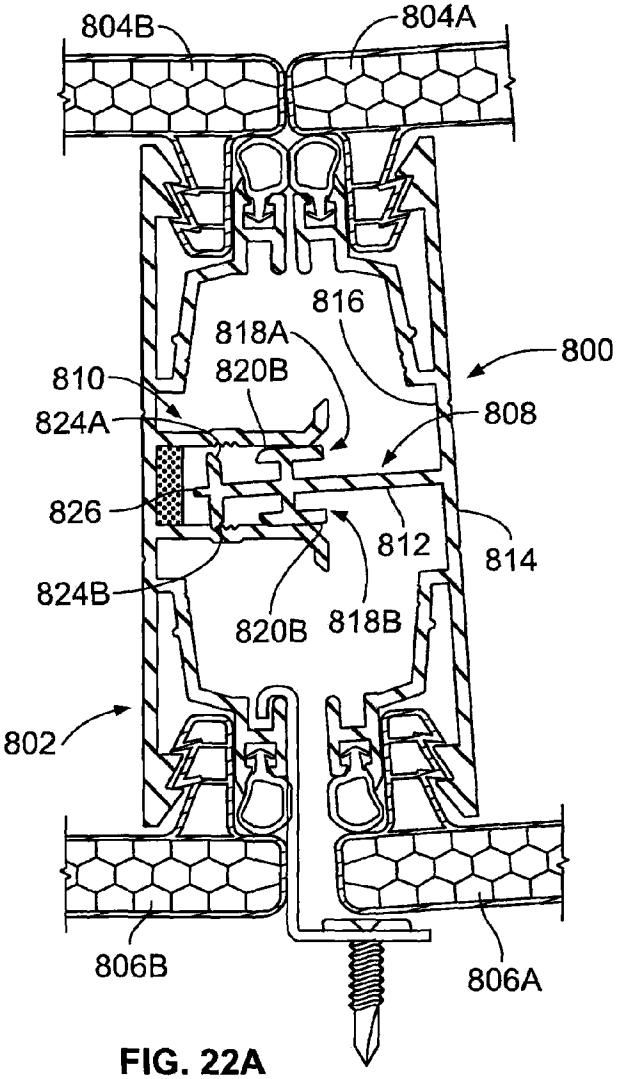

Turning now to FIGS. 22A and 22B, first and second locking members 800 and 802 are shown with top and bottom modular panels 804A/804B and 806A/806B in place in the locking members.

Locking members 800 and 802 are constructed generally like first and second locking members 402 and 404 of FIGS. 11A-11B. However, as will be described below, locking members 800 and 802 differ in the structure of their respective male and female members 808 and 810 which are employed in locking members 800 and 802 in lieu of guide member 470 and receiving cavity 490 of locking members 402 and 404.

Male member 808 includes a spine 812 that projects generally perpendicularly from the front surface 816 of back wall 814. Spine 812 (as well as spine 476 of locking member 402 and the spine of locking member 32) optionally may be offset from 90° at an angle sufficient to accommodate the angle between adjacent panel units of curved panel unit installations.

Spine 812 extends from back wall 816 to a pair of guide, pull-out, and pivot support "T"-shaped rails 818A and 818B which are disposed generally perpendicularly to the rail with the outer faces 820A and 820B of the top of the "T" generally parallel to the corresponding surfaces of spine 812 to help guide the male member into the interlock cavity and to abut the inner surfaces of the cavity sidewalls. The leading edges 822A and 822B optionally are radiused as shown to facilitate entry into female member 810.

Continuing along spine 812, at a distance "A" from guide, pull-out, and pivot support T rails 818A and 818, a pair of generally flat catch rails 822A and 822B are located and oriented perpendicularly to spine 812. The distal edges of the catch rails have bevels 824A and 824B. Finally, spine 812 projects beyond the catch rails along a distal lip 826. The distal end of the lip may be beveled to present a knife-like leading edge.

Female member 810 includes sidewalls 826A and 826B which define an interlock cavity 828 for receiving male member 808. A series of serrations 830A and 830B are formed along the inside surface of sidewalls 826A and 826B. While three serrations are shown, any desired number may be used. Sidewalls 826A and 826B extend to their distal edge 832A/832B where angled walls 834A and 834B are present to facilitate the entrance of member 808 to cavity 828. Distal edges 832 are spaced from the first of serrations 830A/830B a distance "B". Finally, a gasket 836 is located at the closed distal end of cavity 828.

A pair of panels 804A/806A are mounted in first locking member 800 and a pair of panels 804B/806B are mounted in second locking member 802 to respectively form panel units 840 and 842.

In FIG. 22A, panel units 840 and 842 are shown with their locking members interlocked and a retaining clip 844 holding the panel units against a purlin or other support member (not shown). As in this and the various other locking member designs described earlier, panel expansion and contraction due to ambient temperature changes is accommodated by generally lateral movement of the male member of a first locking member in the receiving cavity of the second locking member.

In the configuration of this figure, an internal gutter 846 is formed to receive any water that infiltrates across the space between panels 804A and 804B and moves past gaskets 848A and 848B. Additionally, pressure breaker chambers 850 and 852 are formed between T rails 818A and 818B and catch rails 822A and 822B and the seal formed along lip 826 where it engages gasket 836. Also, it is noted that a particularly efficient sealing is achieved because of the pressure concentrated along the distal edge of the lip which may partially penetrate the gasket. As illustrated in FIG. 23 if the lip penetrates far enough into the gasket, a seal will be achieved as well along the interstice between the face of the catch rail and the exposed surface of the gasket. In a less preferred alternative a lip will not be provided but greater force will be required in order to establish a seal.

FIG. 22A shows what happens in this structure when a negative (wind) force is applied along the surface of panels 804A and 804B tending to pivot the first locking member away from the second locking member. Some of the wind force may be absorbed by flexure of the panels which are made of flexible resin. In this case, edge 832A acts as a leverage point where it engages the outer face of T rail 818A so that the portion of spine 812 extending between the T rail and wall 816 acts as a lever arm producing a high downward force along bevel 824B of the catch rail which engages one of serrations 830B to concentrate the force along the outer bevel edges and resist further movement of the first locking member from its engagement with the second locking member. Distances "A" and "B" are made generally equal to ensure that the T rail engages edge 832A while the bevel of the catch rail is located adjacent the serrations.

When a positive load is applied due to, for example, snow accumulating on panels 804A and 804B, the orientation of the first engagement member is reversed so that the bevel rests in serrations 830A. Further, it is noted that while less preferred, the serrations may be dispensed with since the substantial force of the bevel edges against one of the inner surfaces of sidewalls 826A or 826B will also resist such separation between the locking members under load. In yet another alternative the inner surface may be roughened or coated with a non-slip material to resist slippage of the bevels.

Figure 22C:
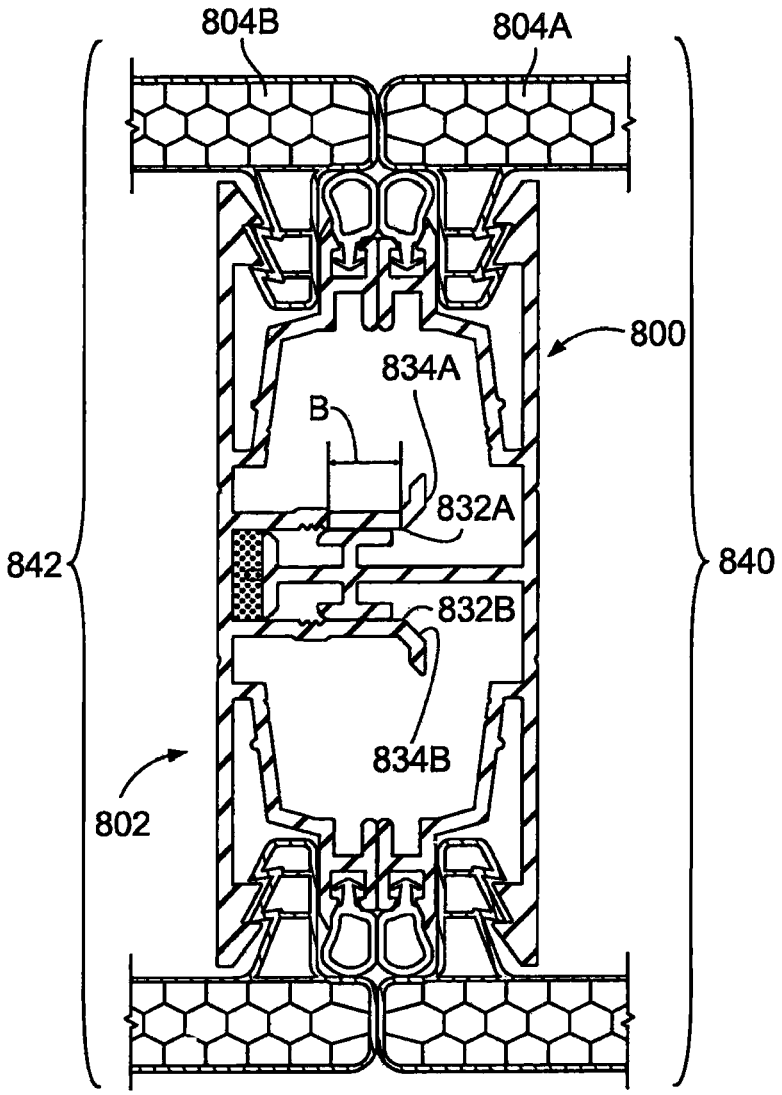

FIG. 22C generally corresponds to FIG. 22A except that in this embodiment retaining clips are not used and panels 804A/806A abut the edges of panels 804B/806B.

Figure 23B:
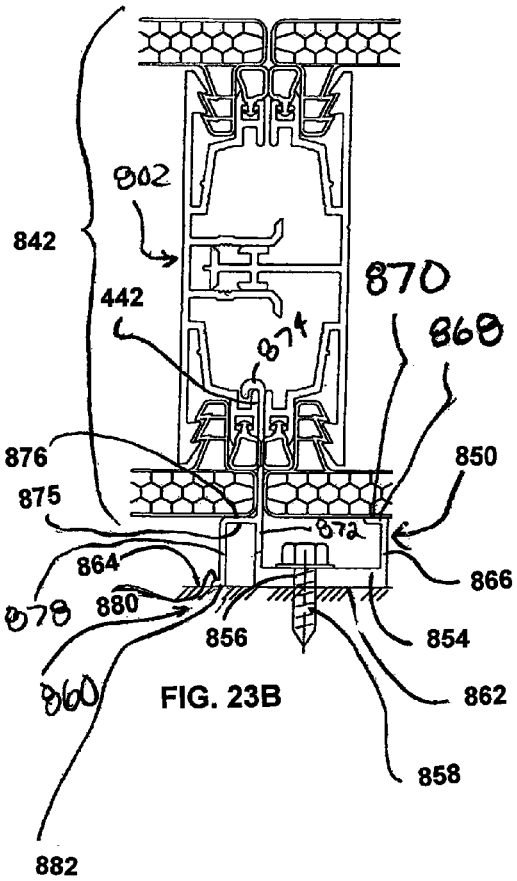
FIGS. 23A and 23B are, respectively, partial perspective and partial side elevation views showing an alternative retaining clip design that maintains a predetermined spacing between the lower panels of interlocked panel units and a supporting member.
Figure 23A:
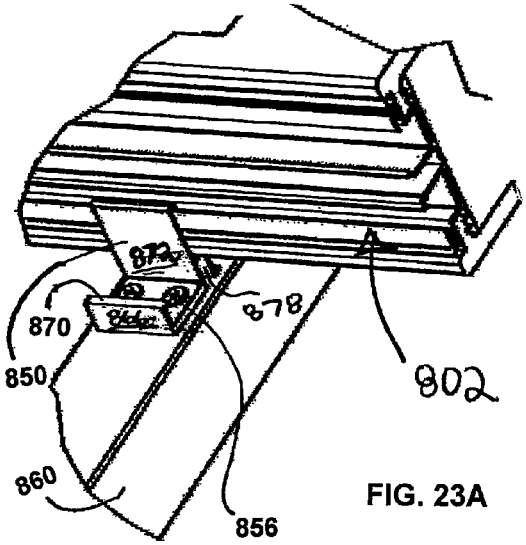

In embodiments it is sometimes necessary to maintain a predetermined spacing between the bottom panels of interlocked panel units and the purlin or other supporting member to which the panel units are attached. For example, such spacing may be required to align the top surface of the upper panels of the panel units with side framing members like those of support frame 520 of FIG. 13. FIGS. 23A and 23B illustrate an important new contribution to the design of retaining clips which makes it possible to easily and efficiently maintain such predetermined spacing.

Thus, retaining clip 850 is shown in these figures engaging second engagement member 802 of panel unit 842 in FIG. 23B. Retaining clip 850 includes a base 854 having a bore 856 through which an appropriate fastener 858 is passed to attach the base of the clip to a supporting purlin 860. The base 862 of the clip rests directly onto the top surface 864 of the purlin.

Clip 850 includes an arm 866 that projects upwardly from base 854. A lip 868 projects generally perpendicularly from the arm and has a top surface 870 that is generally parallel to surface 864 of the purlin.

The clip also includes an upstanding wall 872 along its front edge with a hook 874 in engagement with T-shaped member 442 as shown. A clip seat portion 875 projects generally perpendicularly from wall 872. The top surface 876 of the seat and top surface 870 of lip 868 are coplanar so that they respectively support adjacent panels of the interlocked panel units at the same spacing from the purlin surface. Seat 876 includes a leg 878 that projects downwardly and generally perpendicularly from the seat. Finally, a foot portion 880 projects generally perpendicularly forward from the leg. The bottom surface 882 of the foot portion is coplanar with bottom surface 862 of base 854.

As can be seen in FIGS. 23A and 23B the spacing maintained between the bottom surface of the lower panel unit panels and the purlin is determined by the distance of top lip surface 870 and seat surface 876 from the bottom 862 of the base and the bottom surface 882 of foot portion 880. Therefore, these distances may be adjusted in forming retaining clips of this design in order to accommodate different desired spacings.

Figure 24:
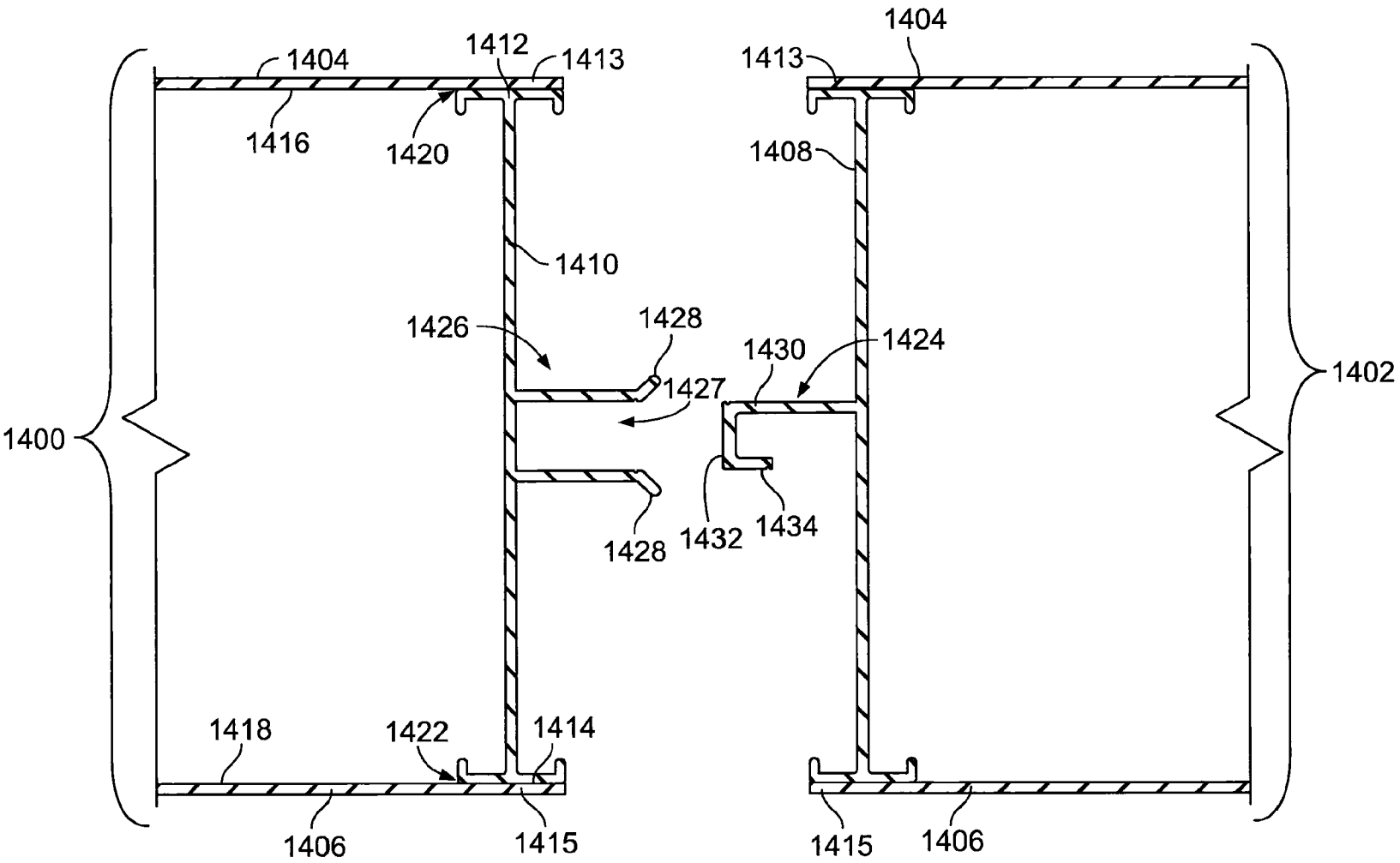
FIG. 24 depicts fiberglass sandwich panels in a partial side elevation view fitted to a pair of locking members prior to engagement of the locking members.

FIG. 24 depicts a pair of fiberglass sandwich panels 1400 and 1402. The sandwich panels each include top panels 1404 and bottom panels 1406. Although the top and bottom panels are shown to be of the same thickness in this figure, a thinner lower panel may suffice in many applications due to the structural integrity provided by the metal locking engagement members. Also, while the panels are referred to as being made of fiberglass, panels made of other transparent or translucent resins may be used.

Sandwich panels 1400 and 1402 are provided with corresponding first and second metal locking rails 1408 and 1410 adjacent the lateral edges 1413 and 1415 of the panels. The locking rails are generally "I-beam" shaped and include top and bottom shelf supports 1412 and 1414 which are adhered to the inner surfaces 1416 and 1418 of the top and bottom panels by way of an appropriate adhesive located in the interstices 420 and 422 between inner surfaces 416/418 and top and bottom shelf supports 1412/1414.

Corresponding first and second locking engagement members 1424 and 1426 are located generally midway along rails 1408 and 1410. The rails are oriented so that the first and second locking engagement members project away from the panels. As shown, in FIG. 24 the second locking engagement member is generally U shaped and includes an inner cavity 1427 and outwardly projected lips 1428 which help guide the first locking engagement member into the second locking engagement member. The first locking engagement member, in turn, includes an upstanding rail 1430, an end flange 1432, with an inwardly directed lip 1434. As is apparent from this figure, when the adjacent sandwich panels are to be assembled, they are moved together so that the second locking engagement member receives the first locking engagement member in locking engagement. And, by assembling a series of sandwich panels together in this way on an appropriate support, a transparent or translucent architectural structure may be quickly and efficiently constructed.

While FIG. 24 illustrates first and second locking engagement member pair embodiments, any of the guide members and engaging cavity designs of the locking engagement members as illustrated in the earlier Figures and described above may be used in place of locking engagement members 424 and 426.

Figure 25:
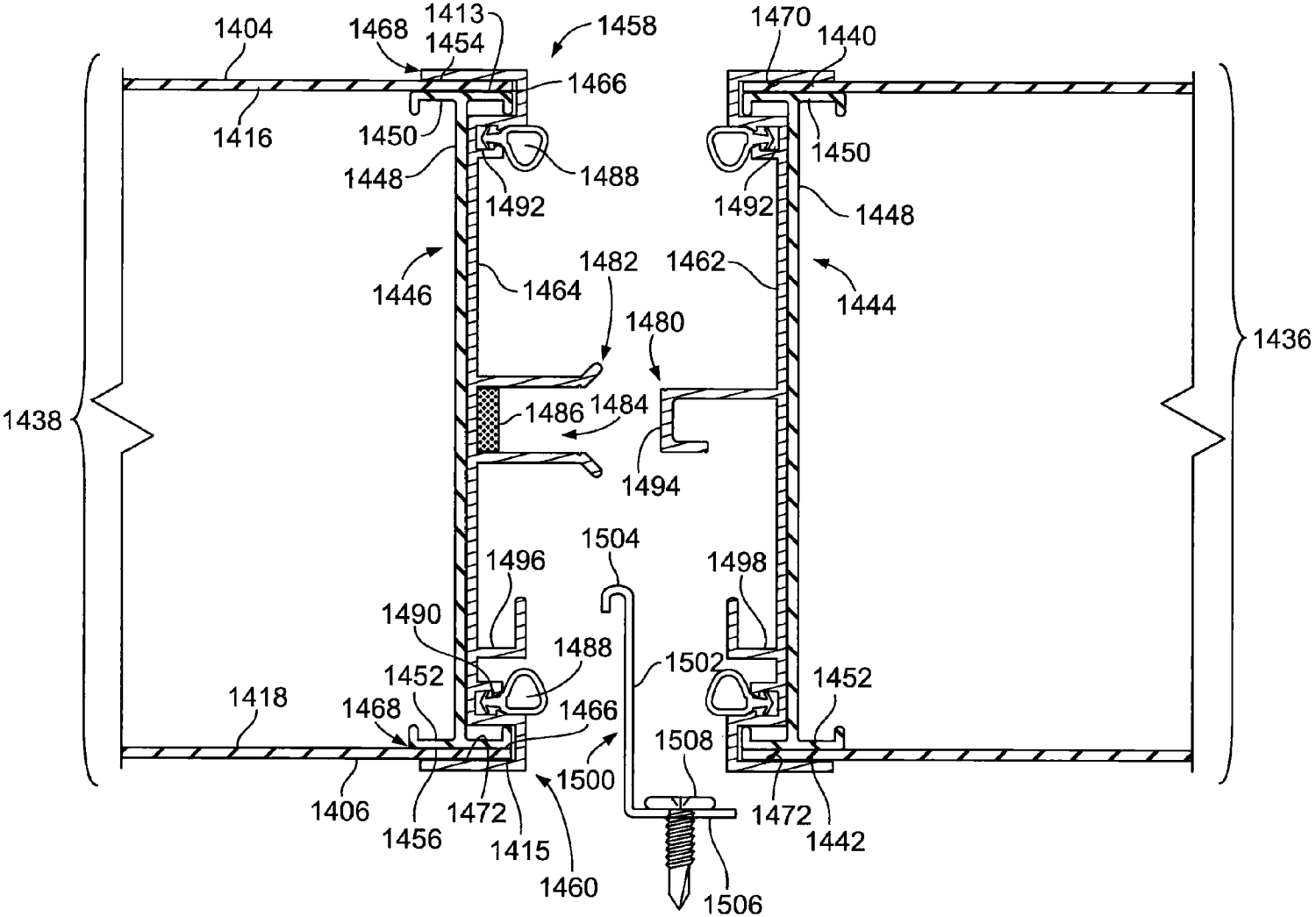
FIG. 25 is a partial side elevation view of a pair of laterally disposed sandwich panels with an alternative locking members design that includes, inter alia, gasketing.
Figure 26:
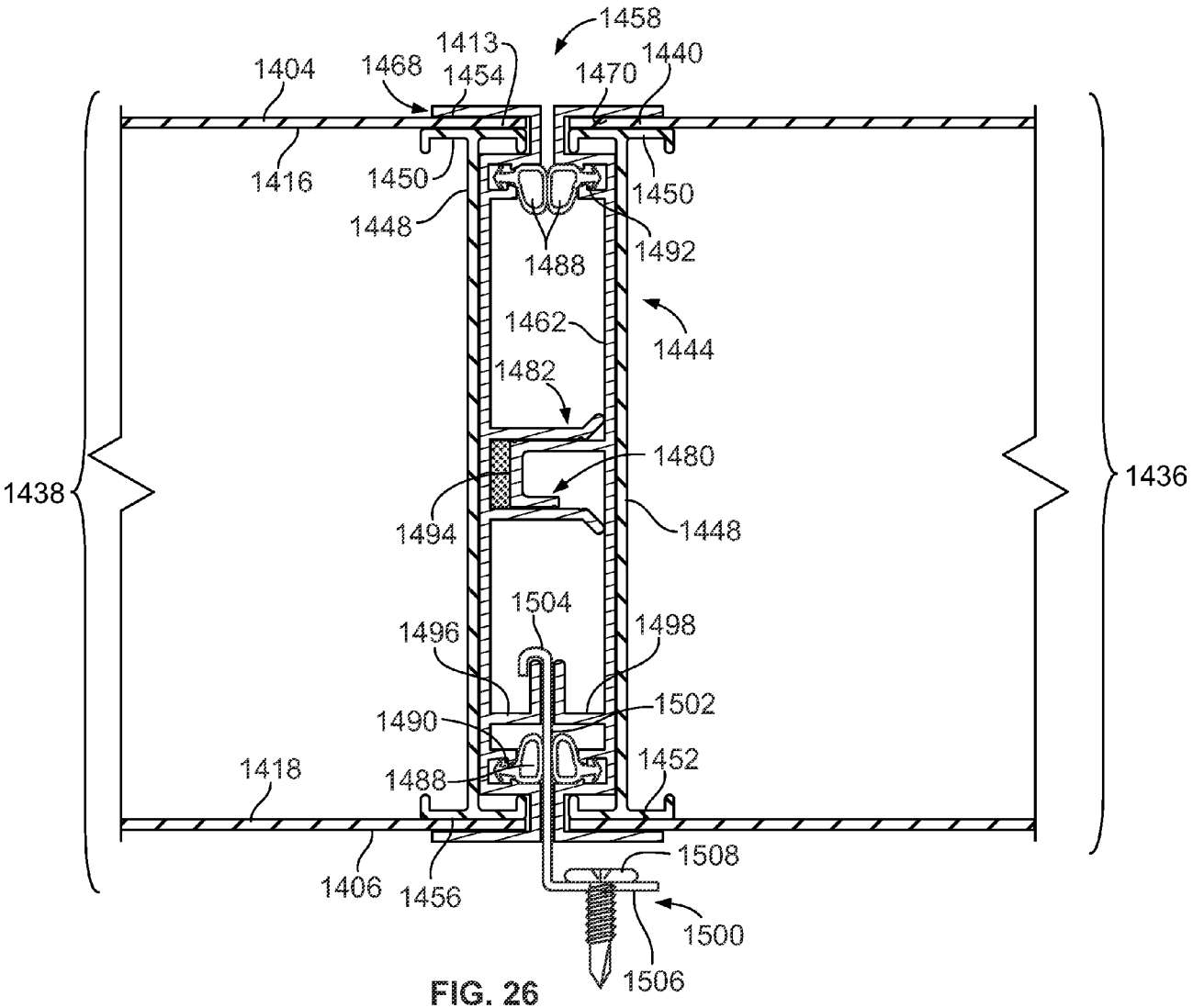
FIG. 26 depicts the sandwich panels and locking members of FIG. 25 after the adjacent panels are interlocked and clipped in place.

Finally, FIG. 25 depicts a pair of laterally disposed sandwich panels 1436 and 1438 in which the lateral edges 1413 and 1415 of the top and bottom fiberglass panels 1404 and 1406 are captured in first and second metal locking rails 1444 and 1446 where each of these locking rails includes an inner panel support member 1448 with top and bottom shelf supports 1450 and 1452. Although the shelf supports may be adhered to the inner surfaces 1416 and 1418 of the top and bottom resin panels, preferably they are not adhered. Rather, the lateral edges of the panels are captured between the outer surfaces 1454 and 1456 of the top and bottom shelf supports and flanges 1458 and 1460 of first and second outer support members 1462 and 1464. The flanges each include an interior cavity 1466 which enables the outer rails to be pressed home against the inner rails trapping the lateral edges of the panels in the space 1468 between the outer surfaces of the inner rails and the inner surfaces 1470 and 1472 of flanges 1458 and 1460.

Corresponding first and second locking engagement members 1480 and 1482 are located generally midway along outer support members 1462 and 1464. As can be seen in FIG. 25, these first and second locking engagement members generally correspond to locking engagement members 1424 and 1426 of FIG. 24 except that locking engagement member 1482 is provided with a resilient member 1486 at the bottom of cavity 1484 of this locking engagement member.

Optional compressible gaskets 1488 may be positioned at opposite ends of outer rails 1462 and 1464, above flanges 1458 and 1460. These gaskets are made of an elastic material such as a synthetic rubber and are held in place by locking engagement members 1490 which hook into cavities 1492.

Finally, outer support members 1462 and 1464 are provided with upwardly opening flanges 1496 and 1498. Similar upwardly opening flanges to receive retention clips may be provided along the inner edge of rails 1408 and 1410 of FIG. 24. Flanges 1496 and 1498 are to be used in conjunction with metal retention clips 1500 which are designed and function much the same as retention clips 34 described earlier.

Retention clips 1500 include a base 1506 with a hole for receiving a fastener 1508 which will be driven or screwed into a purlin, rafter or other support to hold adjoining sandwich panels in place. The clips also include an upstanding wall 1502 and an engagement hook 1504 which is dimensioned to engage flange 1596. Thus, this retention clip can be used to fix sandwich panel 1438 in place during the onsite erection of glazing, skylights, roofs, walls, etc. whereupon sandwich panel 1436 can be laterally aligned as shown and moved into place so the first and second locking engagement members engage and the end flange 1494 of locking engagement member 1480 will compress resilient member 1486 at the bottom of cavity 1484 forming an air and water resistant seal at that point and gaskets 1488 will abut forming air and water resistant seals along the gaskets between the adjacent sandwich panels. This final construction is illustrated in FIG. 24.

Installation of the adjacent panels of FIGS. 24 and 25 may proceed generally as discussed above.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing embodiments to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments does not pose a limitation on the scope of the invention unless otherwise claimed.

Finally, it should be understood that the illustrated embodiments are exemplary only, and should not be taken as limiting the scope of the invention.

What I claim is:

1. A panel unit assembly comprising:

interlocked first and second engagement members each having panel-receiving cavities for receiving and retaining edge portions of panels;

two pairs of opposed transparent or translucent panels mounted in the panel receiving cavities of the first and second engagement members with an airspace disposed between the panels to form adjacent interlocked panel units;

the panel units being subject to positive and negative forces that cause the engagement members to pivot with respect to each other;

the first engagement member having a wall disposed between the first pair of panels and a male member projecting from the wall, the male member including a catch rail with a distal edge;

the second engagement member having a back wall disposed between the panels and a pair of sidewalls defining an interlock cavity with sidewalls and an opening for receiving the male member, the male member catch rail being disposed adjacent to inner surfaces of the interlock cavity sidewalls to engage the sidewall inner surfaces and limit the pivoting movement of the engagement members; and serrations along the inner surface of the interlock cavity sidewalls positioned for engagement with the distal edge of the catch rail when the engagement members pivot with respect to each other.

2. The panel unit assembly of claim 1 in which the pairs of opposed panels include top panels with opposed edges and the interlocked engagement members form an internal gutter for collecting water that infiltrates past the opposed edges of the top panels of adjoining panel units.

3. The panel unit assembly of claim 1 in which the interlocked engagement members form a pressure breaker chamber.

4. The panel unit assembly of claim 1 in which the interlocked engagement members form a plurality of pressure breaker chambers.

5. The panel unit assembly of claim 1 in which the transparent or translucent panels are flat panels with opposed edge portions and the opposed edge portions of the flat panels are mounted in the panel receiving cavities of the first and second engagement members.

6. The panel unit assembly of claim 1 in which the panels of the panel units are flexible and absorb a portion of the positive and negative forces.

7. The panel unit assembly of claim 1 in which the pairs of transparent or translucent panels of the panel units have corresponding elongated upwardly and downwardly directed flanges disposed at opposite lateral edges of the panels and the panel-receiving cavities receive and retain the flanges.

8. The panel unit assembly of claim 7 in which the interlocked engagement members are made of metal and the panels have skins with substantially lower ultimate tensile strength than the ultimate tensile strength of the interlocked metal engagement members.

9. The panel unit assembly of claim 7 in which the panel flanges each include at least one sawtooth and the panel receiving cavities of the interlocked engagement members have at least one sawtooth engaging the at least one sawtooth of the panel flanges.

10. The panel unit assembly of claim 1 in which the male member includes a pair of catch rails with distal edges and the interlock cavity serrations are along the opposite inside sidewall surfaces of the cavity.

11. The panel unit assembly of claim 10 in which the male member projects substantially perpendicularly from the wall disposed between the first pair of panels and the catch rails project substantially perpendicularly to and away from the male member.

12. The panel unit assembly of claim 11 in which the catch rail has a distal edge and the distal edge of the catch rail has a bevel.

13. The panel unit assembly of claim 1 in which a resilient member is disposed in the interlock cavity of the second engagement member and the male member includes a distal lip that projects beyond the catch rail for engaging the resilient member.

14. The panel unit assembly of claim 13 in which the distal lip is beveled to present a knife-shaped leading edge.

15. The panel unit assembly of claim 1 in which guide and pivot support T rails project from opposite sides of the male member and are dimensioned to abut the inner surfaces of the cavity sidewalls as the male member moves into the interlock cavity.

16. The panel unit assembly of claim 15 in which the sidewalls of the interlock cavity include distal edges at the cavity opening engaging the pivot support T rails to define a level point for leveraging the catch rails against the inner surfaces of the sidewalls of the interlock cavity.

17. A panel unit assembly comprising:

interlocked first and second engagement members each having panel-receiving cavities for receiving and retaining edge portions of panels;

two pairs of opposed transparent or translucent panels mounted in the panel receiving cavities of the first and second engagement members with an airspace disposed between the panels to form adjacent interlocked panel units;

the panel units being subject to positive and negative forces that cause the engagement members to pivot with respect to each other;

the first engagement member having a wall disposed between the first pair of panels and a male member projecting from the wall, the male member including a catch rail with a distal edge;

the second engagement member having a back wall disposed between the panels and a pair of sidewalls defining an interlock cavity with sidewalls and an opening for receiving the male member, the male member catch rail being disposed adjacent to inner surfaces of the interlock cavity sidewalls to engage the sidewall inner surfaces and limit the pivoting movement of the engagement members; and the inner surface of the interlock cavity sidewalls positioned for engagement with the distal edge of the catch rail to resist slippage when the engagement members pivot with respect to each other.

18. The panel unit of claim 17 in which the inner surface includes a non-slip coating or a roughened surface.

19. A panel unit assembly comprising:

interlocked first and second engagement members each having panel-receiving cavities for receiving and retaining edge portions of panels;

two pairs of opposed transparent or translucent panels mounted in the panel receiving cavities of the first and second engagement members with an airspace disposed between the panels to form adjacent interlocked panel units;

the panel units being subject to positive and negative forces that cause the engagement members to pivot with respect to each other;

the first engagement member having a wall disposed between the first pair of panels and a male member projecting from the wall, the male member including a catch rail with a distal edge;

the second engagement member having a back wall disposed between the panels and a pair of sidewalls defining an interlock cavity with sidewalls and an opening for receiving the male member, the male member catch rail being disposed adjacent to inner surfaces of the interlock cavity sidewalls to engage the sidewall inner surfaces and limit the pivoting movement of the engagement members; and guide and pivot support T rails projecting from opposite sides of the male member dimensioned to abut the inner surfaces of the cavity sidewalls.

20. The panel unit assembly of claim 19 in which the pairs of opposed panels include top panels with opposed edges and the interlocked engagement members form an internal gutter for collecting water that infiltrates past the opposed edges of the top panels of adjoining panel units.

21. The panel unit assembly of claim 19 in which the interlocked engagement members form a pressure breaker chamber.

22. The panel unit assembly of claim 19 in which the interlocked engagement members form a plurality of pressure breaker chambers.

23. The panel unit assembly of claim 19 in which the transparent or translucent panels are flat panels with opposed edge portions and the opposed edge portions of the flat panels are mounted in the panel receiving cavities of the first and second engagement members.

24. The panel unit assembly of claim 19 in which the male member includes a pair of catch rails with distal edges and the interlock cavity serrations are along the opposite inside sidewall surfaces of the cavity.

25. The panel unit assembly of claim 19 in which the panels of the panel units are flexible and absorb a portion of the positive and negative forces.

26. The panel unit assembly of claim 19 in which the pairs of transparent or translucent panels of the panel units have corresponding elongated upwardly and downwardly directed flanges disposed at opposite lateral edges of the panels and the panel-receiving cavities receive and retain the flanges.

27. The panel unit assembly of claim 26 in which the interlocked engagement members are made of metal and the panels have skins with substantially lower ultimate tensile strength than the ultimate tensile strength of the interlocked metal engagement members.

28. The panel unit assembly of claim 26 in which the panel flanges each include at least one sawtooth and the panel receiving cavities of the interlocked engagement members have at least one sawtooth engaging the at least one sawtooth of the panel flanges.

29. The panel unit assembly of claim 19 in which the male member projects substantially perpendicularly from the wall disposed between the first pair of panels and the catch rails project substantially perpendicularly to and away from the male member.

30. The panel unit assembly of claim 29 in which the catch rail has a distal edge and the distal edge of the catch rail has a bevel.

31. The panel unit assembly of claim 19 in which a resilient member is disposed in the interlock cavity of the second engagement member and the male member includes a distal lip that projects beyond the catch rail for engaging the resilient member.

32. The panel unit assembly of claim 31 in which the distal lip is beveled to present a knife-shaped leading edge.

33. The panel unit assembly of claim 19 in which the panel receiving cavity of the second engagement member includes cavity side walls and the guide and pivot support T rails projecting from opposite sides of the male member, dimensioned to abut the inner surfaces of the cavity sidewalls as the male member moves into the interlock cavity.

34. The panel unit assembly of claim 33 in which the sidewalls of the interlock cavity include distal edges at the cavity opening engaging the tops of the pivot support T rails to define an edge point for leveraging the catch rails against the inner surfaces of the sidewalls of the interlock cavity.

35. A panel unit assembly comprising:

interlocked first and second engagement members each having panel-receiving cavities for receiving and retaining edge portions of panels;

two pairs of opposed transparent or translucent panels mounted in the panel receiving cavities of the first and second engagement members with an airspace disposed between the panels to form adjacent interlocked panel units;

the panel units being subject to positive and negative forces that cause the engagement members to pivot with respect to each other;

the first engagement member having a wall disposed between the first pair of panels and a male member projecting from the wall, the male member including a catch rail with a distal edge and a distal lip that projects beyond the catch rails;

the second engagement member having a back wall disposed between the panels and a pair of sidewalls defining an interlock cavity with sidewalls and an opening for receiving the male member, the male member catch rail being disposed adjacent to inner surfaces of the interlock cavity sidewalls to engage the sidewall inner surfaces and limit the pivoting movement of the engagement members; and a resilient member disposed in the interlock cavity of the second engagement member in engagement with the distal lip.

36. The panel unit assembly of claim 35 in which the pairs of opposed panels include top panels with opposed edges and the interlocked engagement members form an internal gutter for collecting water that infiltrates past the opposed edges of the top panels of adjoining panel units.

37. The panel unit assembly of claim 35 in which the interlocked engagement members form a pressure breaker chamber.

38. The panel unit assembly of claim 35 in which the transparent or translucent panels are flat panels with opposed edge portions and the opposed edge portions of the flat panels are mounted in the panel receiving cavities of the first and second engagement members.

39. The panel unit assembly of claim 35 in which the male member projects substantially perpendicularly from the wall disposed between the first pair of panels and the catch rails project substantially perpendicularly to and away from the male member.

40. The panel unit assembly of claim 35 in which the distal lip is beveled to present a knife-shaped leading edge.

41. The panel unit assembly of claim 35 in which the male member includes a pair of catch rails with distal edges and the interlock cavity serrations are along the opposite inside sidewall surfaces of the cavity.

42. The panel unit assembly of claim 35 in which the pairs of transparent or translucent panels of the panel units have corresponding elongated upwardly and downwardly directed flanges disposed at opposite lateral edges of the panels and the panel-receiving cavities receive and retain the flanges.

43. The panel unit assembly of claim 42 in which the interlocked engagement members are made of metal and the panels have skins with substantially lower ultimate tensile strength than the ultimate tensile strength of the interlocked metal engagement members.

44. The panel unit assembly of claim 42 in which the panel flanges each include at least one sawtooth and the panel receiving cavities of the interlocked engagement members have at least one sawtooth engaging the at least one sawtooth of the panel flanges.

45. A panel unit assembly comprising:

interlocked first and second engagement members each having panel-receiving cavities for receiving and retaining edge portions of panels;

two pairs of opposed transparent or translucent panels mounted in the panel receiving cavities of the first and second engagement members with an airspace disposed between the panels to form adjacent interlocked panel units;

the panel units being subject to positive and negative forces that cause the engagement members to pivot with respect to each other;

the first engagement member having a wall disposed between the first pair of panels and a male member projecting from the wall, the male member including a catch rail with a distal edge;

the second engagement member having a back wall disposed between the panels and a pair of sidewalls defining an interlock cavity with sidewalls and an opening for receiving the male member, the male member catch rail being disposed adjacent to inner surfaces of the interlock cavity sidewalls to engage the sidewall inner surfaces and limit the pivoting movement of the engagement members; and a resilient member engaging an interior portion of the interlock cavity and the male member.

46. A panel unit assembly mounted to a support surface comprising:

a support surface;

metal interlocked first and second engagement members each having panel-receiving cavities for receiving and retaining edge portions of panels and at least one of the engagement members having an engaging surface for engaging a retention clip;

two pairs of opposed transparent or translucent panels mounted in the panel receiving cavities of the first and second engagement members with an airspace disposed between the panels to form adjacent interlocked panel units;

the panel units being subject to positive and negative forces that cause the engagement members to pivot with respect to each other;

the first engagement member having a wall disposed between the first pair of panels and a male member projecting from the wall, the male member including a catch rail with a distal edge;

the second engagement member having a back wall disposed between the panels and a pair of sidewalls defining an interlock cavity with sidewalls and an opening for receiving the male member, the male member catch rail being disposed adjacent to inner surfaces of the interlock cavity sidewalls to engage the sidewall inner surfaces and limit the pivoting movement of the engagement members; and a metal retention clip affixed to the support surface and in metal-to-metal engagement with an engaging surface of at least one metal retention member.

* * * * *